US012496677B2

(12) United States Patent
Sasaki et al.

(10) Patent No.: US 12,496,677 B2
(45) Date of Patent: Dec. 16, 2025

(54) POLISHING APPARATUS AND POLISHING METHOD

(71) Applicant: EBARA CORPORATION, Tokyo (JP)

(72) Inventors: Toshimitsu Sasaki, Tokyo (JP); Keita Yagi, Tokyo (JP); Yoichi Shiokawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 507 days.

(21) Appl. No.: 17/680,779

(22) Filed: Feb. 25, 2022

(65) Prior Publication Data

US 2022/0371153 A1 Nov. 24, 2022

(30) Foreign Application Priority Data

Mar. 1, 2021 (JP) ..... 2021-031850

(51) Int. Cl.
*B24B 37/013* (2012.01)
*B24B 37/32* (2012.01)
(Continued)

(52) U.S. Cl.
CPC ..... *B24B 37/013* (2013.01); *B24B 37/32* (2013.01); *B24B 49/04* (2013.01); *B24B 49/105* (2013.01); *B24B 49/12* (2013.01); *B24B 49/16* (2013.01)

(58) Field of Classification Search
CPC ..... B24B 37/013; B24B 37/32; B24B 37/10; B24B 37/005; B24B 37/30; B24B 37/02;
(Continued)

(56) References Cited

U.S. PATENT DOCUMENTS

2007/0082589 A1 4/2007 Zuniga et al.
2008/0146119 A1* 6/2008 Sasaki ..... B24B 37/30 451/514
(Continued)

FOREIGN PATENT DOCUMENTS

CN 1279506 A 1/2001
CN 103659575 A 3/2014
(Continued)

*Primary Examiner* — David S Posigian
*Assistant Examiner* — Michael A Gump
(74) *Attorney, Agent, or Firm* — BakerHostetler

(57) ABSTRACT

A polishing apparatus capable of obtaining a desired film thickness profile is disclosed. The polishing apparatus includes: a polishing unit; a film thickness measuring device for measuring a film thickness profile of a substrate; and a controller for controlling at least operations of the polishing unit and the film thickness measuring device. The controller stores in advance a response model which is created by taking into consideration variation in an amount of polishing between monitored areas of the substrate due to variations in a pressure of a pressurized fluid supplied to each of pressure chambers. Further, the controller obtains a film thickness profile of the substrate before polishing by use of a film thickness measuring device, and causes the substrate to be polished with an optimized polishing recipe created based on the response model and a target polishing amount, which is a difference between the film thickness profile of the substrate before polishing and the target film thickness of the substrate. A next substrate is polished with a new optimized polishing recipe which is created based on a target polishing amount of the next substrate and a response model corrected by use of the optimized polishing recipe and film thickness profiles of the substrate before and after polishing.

16 Claims, 17 Drawing Sheets

(51) Int. Cl.
*B24B 49/04* (2006.01)
*B24B 49/10* (2006.01)
*B24B 49/12* (2006.01)
*B24B 49/16* (2006.01)

(58) Field of Classification Search
CPC ..... B24B 37/04; B24B 37/042; B24B 37/105; B24B 37/107; B24B 49/04; B24B 49/105; B24B 49/12; B24B 49/16; B24B 49/00; B24B 49/02; B24B 49/03; B24B 49/10; B24B 7/228; B24B 27/0023; B24B 53/017; H01L 21/67092; H01L 21/67253
USPC ..... 451/5
See application file for complete search history.

(56) References Cited

U.S. PATENT DOCUMENTS

2008/0268751 A1* 10/2008 Yokoyama ..... B24B 49/12 451/8
2009/0239446 A1* 9/2009 Fukuda ..... B24B 37/005 451/526
2015/0147829 A1* 5/2015 Benvegnu ..... B24B 49/04 451/5
2015/0255357 A1* 9/2015 Kobayashi ..... H01L 21/67063 156/345.13
2019/0009385 A1* 1/2019 Hiroo ..... B24B 49/105
2019/0134774 A1* 5/2019 Yagi ..... B24B 37/32
2019/0160626 A1 5/2019 Watanabe et al.
2019/0240799 A1* 8/2019 Takeda ..... B24B 49/04

FOREIGN PATENT DOCUMENTS

CN 205271697 U 6/2016
CN 106863108 A 6/2017
CN 208681336 U 4/2019
JP H10-118917 A 5/1998
JP 2005-011977 A 1/2005
JP 2006-082169 A 3/2006
JP 2015-193068 A 11/2015
JP 2019-102518 A 6/2019
JP 2020-104200 A 7/2020

* cited by examiner

FIG. 9

$$\mathrm{R} = \begin{bmatrix} R1 \\ R2 \\ R3 \\ \vdots \\ Rm \end{bmatrix}$$

$$\mathrm{C} = \begin{bmatrix} C1a & C1b & C1c & \dots & C1h \\ C2a & C2b & C2c & \dots & C2h \\ C3a & C3b & C3c & \dots & C3h \\ \vdots & \vdots & \vdots & \dots & \vdots \\ Cma & Cmb & Cmc & \dots & Cmh \end{bmatrix}$$

$$\mathrm{D} = \begin{bmatrix} D1 \\ D2 \\ D3 \\ \vdots \\ Dm \end{bmatrix}$$

$$\mathrm{X} = \begin{bmatrix} Pa \\ Pb \\ Pc \\ \vdots \\ Ph \end{bmatrix}$$

FIG. 10

$$C' = \begin{bmatrix} C1a & C1b & C1c & \dots & C1h & C1i \\ C2a & C2b & C2c & \dots & C2h & C2i \\ C3a & C3b & C3c & \dots & C3h & C3i \\ \vdots & \vdots & \vdots & \dots & \vdots & \vdots \\ Cma & Cmb & Cmc & \dots & Cmh & Cmi \end{bmatrix}$$

$$X' = \begin{bmatrix} Pa \\ Pb \\ Pc \\ \vdots \\ Ph \\ Pi \end{bmatrix}$$

POLISHING APPARATUS AND POLISHING METHOD

CROSS REFERENCE TO RELATED APPLICATION

This document claims priority to Japanese Patent Application No. 2021-031850 filed Mar. 1, 2021, the entire contents of which are hereby incorporated by reference.

BACKGROUND

With a recent trend toward higher integration and higher density in semiconductor devices, circuit interconnects become finer and finer and the number of levels in multilayer interconnect is increasing. In the process of achieving the multilayer interconnect structure with finer interconnects, film coverage of step geometry (or step coverage) is lowered through thin film formation as the number of interconnect levels increases, because surface steps grow while following surface irregularities on a lower layer. Therefore, in order to fabricate the multilayer interconnect structure, it is necessary to improve the step coverage and planarize the surface in an appropriate process. Further, since finer optical lithography entails shallower depth of focus, it is necessary to planarize surfaces of semiconductor device so that irregularity steps formed thereon fall within a depth of focus in optical lithography.

Accordingly, in a manufacturing process of the semiconductor devices, a planarization technique of a surface of the semiconductor device is becoming more important. The most important technique in this planarization technique is chemical mechanical polishing. This chemical mechanical polishing (which will be hereinafter called CMP) is a process of polishing a substrate, such as a wafer, by placing the substrate in sliding contact with a polishing pad while supplying a polishing liquid containing abrasive grains, such as silica (SiO2), onto the polishing pad.

A polishing apparatus for performing CMP includes a polishing table that supports a polishing pad having a polishing surface, and a substrate holder, which is referred to as a polishing head (substrate holding apparatus) for holding a wafer. When the wafer is polished with such a polishing apparatus, the polishing table and the polishing head are moved relative to each other while supplying the polishing liquid (slurry) onto the polishing pad disposed on the polishing table, and the wafer is pressed against the polishing surface of the polishing pad under a predetermined pressure by the polishing head. The wafer is brought into sliding contact with the polishing surface in the presence of the polishing liquid, so that the surface of the wafer is polished to a flat finish by a combination of a chemical action of the slurry and a mechanical action of abrasive grains contained in the slurry.

During polishing of the substrate, the surface of the substrate is brought into contact with the rotating polishing pad, and thus a friction force is exerted on the substrate. Therefore, in order to prevent the substrate from being detached from the polishing head during polishing of the substrate, the polishing head is provided with a retainer ring. This retainer ring is disposed so as to surround the substrate. During polishing of the substrate, the retainer ring rotates and presses the polishing pad at the outside of the substrate.

In recent years, there has been increasing demand for more precise control of thickness profile in a substrate (i.e., improvement of uniformity within the surface, which represents flatness of the substrate surface) in order to respond to various initial film thickness profiles which vary depending on semiconductor devices and CMP processes, as well as to improve yields.

Further, an allowable range with respect to a target film thickness is becoming narrower, and thus it is becoming difficult to maintain the film thickness within the required allowable range in the conventional polishing method, which uses a film thickness sensor to acquire a film thickness index value of the substrate during polishing, and terminates polishing of the substrate based on the thickness index value. For example, an amount of polishing during one rotation of the polishing table may be larger than the allowable range. In this case, if an end point of polishing is determined based on the film thickness index value obtained from the film thickness sensor disposed in the polishing table, the film thickness obtained after the end of polishing may exceed the allowable range with respect to the target film thickness.

Further, the film thickness profile before polishing is different among substrates to be polished, and polishing conditions (for example, conditions of the polishing surface of the polishing pad) are different among polishing apparatuses. Due to these combined factors also, it is becoming increasingly difficult to preciously control the film thickness profile, and bring the film thickness profile within the required allowable range.

SUMMARY

Therefore, there is provided a polishing apparatus capable of obtaining a desired film thickness profile. Further, there is provided a polishing method of polishing substrate using such a polishing apparatus.

Embodiments, which will be described below, relate to a polishing apparatus and a polishing method for a substrate, such as a wafer, and particularly relates to a polishing apparatus and a polishing method for polishing a substrate to obtain a desired thickness profile. Further, embodiments, which will be described below, relate to a polishing method for polishing a substrate by use of such polishing apparatus.

In one embodiment, there is provided a polishing apparatus, comprising: at least one polishing unit including a polishing table for supporting a polishing pad, and a substrate holder for pressing a substrate against the polishing pad a film thickness measuring device configured to measure a film thickness profile of the substrate; and a controller configured to control at least operations of the polishing unit and the film thickness measuring device, wherein the substrate holder includes: an elastic membrane film to form a plurality of pressure chambers for pressing the substrate; a head body to which the elastic membrane is attached; and a retainer ring arranged so as to surround the substrate, the controller stores in advance a response model which is created by taking into consideration variation in the amount of polishing between monitored areas of the substrate due to variations in a pressure of a pressurized fluid supplied to each of the pressure chambers, and the controller obtains a film thickness profile of the substrate before polishing by use of a film thickness measuring device; causes the substrate to be polished with an optimized polishing recipe including at least the pressures of the pressurized fluid supplied to each of the plurality of pressure chambers and the polishing time, the optimized polishing recipe being created based on the response model and a target polishing amount, which is a difference between the film thickness profile of the substrate before polishing and the target film thickness of the substrate; and causes a next substrate to be polished with a new optimized polishing recipe which is created based on a target polishing amount of the next substrate and a response model corrected by use of the optimized polishing recipe and film thickness profiles of the substrate before and after polishing.

In one embodiment, the optimal polishing recipe is created by use of an optimization calculation that minimizes an objective function including at least a term for difference between the target polishing amount and a predicted polishing amount calculated by use of the response model.

In one embodiment, the objective function includes a term for differences between pressures of the pressurized fluid of the optimized polishing recipe and preset reference pressures of the pressurized fluid, and/or a term for differences between the pressures of the pressurized fluid of the optimized polishing recipe and pressures of the pressurized fluid used in polishing of the previous substrate.

In one embodiment, the optimization calculation is quadratic programming method.

In one embodiment, the number of the plurality of monitored areas is greater than the number of the plurality of pressure chambers.

In one embodiment, the response model is a response model created by further taking into consideration variation in an amount of polishing between the monitored areas of the substrate due to variation in a pressing force of a retaining ring on the polishing pad, and the optimized polishing recipe further includes the pressing force of the retainer ring.

In one embodiment, the film thickness measuring device is configured to measure a film thickness at a plurality of measurement points set in each of the plurality of monitored areas.

In one embodiment, the response model includes a response coefficient representing an amount of increase in the polishing rate per unit polishing pressure in each of the plurality of monitored areas.

In one embodiment, the polishing apparatus further comprising a plurality of local-load exerting devices for applying a local load to a part of the retainer ring, and the response model is created by further taking into consideration variation in an amount of polishing between the monitored areas due to variation in the local load.

In one embodiment, there is provided a polishing apparatus, comprising: at least one polishing unit including a polishing table for supporting a polishing pad, and a substrate holder for pressing a substrate against the polishing pad; a film thickness measuring device configured to measure a film thickness profile of the substrate; and a controller configured to control at least operations of the polishing unit and the film thickness measuring device, wherein the substrate holder includes: an elastic membrane film to form a plurality of pressure chambers for pressing the substrate; a head body to which the elastic membrane is attached; and a retainer ring arranged so as to surround the substrate, the controller stores in advance film thickness profiles of a plurality of substrates before polishing and response models for polishing each of the plurality of substrates, the response models being created by taking into consideration variation in the amount of polishing between monitored areas of the substrate due to variations in a pressure of each of the pressure chambers, and classifies in advance the film thickness profiles of the plurality of substrates before polishing into a plurality of groups to which the film thickness profiles similar to each other belong, the controller obtains a film thickness profile of the substrate before polishing by use of the film thickness measuring device, determines a group, to which the film thickness profile of the substrate before polishing belongs, from the plurality of groups, causes the substrate to be polished with an optimized polishing recipe including at least the pressures of the pressurized fluid supplied to each of the plurality of pressure chambers and the polishing time, the optimized polishing recipe being created based on a target polishing amount, which is a difference between the film thickness profile of the substrate before polishing and the target film thickness of the substrate, and a response model associated with the determined group, and causes a next substrate to be polished with a new optimized polishing recipe which is created based on a target polishing amount of the next substrate, and a response model corrected by use of the optimized polishing recipe and film thickness profiles of the substrate before and after polishing.

In one embodiment, there is provided a polishing apparatus, comprising: a plurality of polishing units each including a polishing table for supporting a polishing pad, and a substrate holder for pressing a substrate against the polishing pad; and a controller configured to control at least operation of the polishing units, wherein the substrate holder includes: an elastic membrane film to form a plurality of pressure chambers for pressing the substrate; a head body to which the elastic membrane is attached; and a retainer ring arranged so as to surround the substrate, the substrate is a substrate which is polished by a plurality of polishing processes including a first polishing and a second polishing performed in the polishing unit different from the polishing unit in which the first polishing has been performed, the polishing unit in which the first polishing is performed has a film thickness sensor for measuring a thickness profile of the substrate, the controller stores in advance a response model for the second polishing which is created by taking into consideration variation in the amount of polishing between monitored areas of the substrate due to variations in a pressure of a pressurized fluid supplied to each of the pressure chambers, and the controller obtains, after performing the first polishing a film thickness profile of the substrate before the second polishing by use of the film thickness sensor, causes the substrate to be second polished with an optimized polishing recipe for the second polishing including at least the pressures of the pressurized fluid supplied to each of the plurality of pressure chambers and the polishing time, the optimized polishing recipe being created based on a target polishing amount, which is a difference between the film thickness profile of the substrate before the second polishing and the target film thickness of the substrate, and the response model for the second polishing, and causes a next substrate to be second polished with a new optimized polishing recipe for the second polishing which is created based on a target polishing amount of the next substrate, and a response model corrected by use of the optimized polishing recipe for the second polishing and film thickness profiles of the substrate before and after the second polishing.

In one embodiment, there is provided a polishing apparatus, comprising: at least one polishing unit including a polishing table for supporting a polishing pad, and a substrate holder for pressing a substrate against the polishing pad; a film thickness measuring device configured to measure a film thickness profile of the substrate; and a controller configured to control at least operations of the polishing unit and the film thickness measuring device, wherein the substrate holder includes: an elastic membrane film to form a plurality of pressure chambers for pressing the substrate; a head body, to which the elastic membrane is attached; and a retainer ring arranged so as to surround the substrate, the substrate is a substrate which is polished by a plurality of polishing processes including a first polishing and a second polishing performed in the polishing unit different from the polishing unit in which the first polishing has been performed, the polishing unit in which the second polishing is performed has a film thickness sensor for measuring a film thickness profile of the substrate, the controller stores in advance a response model for the first polishing which is created by taking into consideration variation in the amount of polishing between monitored areas of the substrate due to variations in a pressure of a pressurized fluid supplied to each of the pressure chambers, and the controller obtains a film thickness profile of the substrate before the first polishing by use of the film thickness sensor, causes the substrate to be first polished with an optimized polishing recipe for the first polishing including at least the pressures of the pressurized fluid supplied to each of the plurality of pressure chambers and the polishing time, the optimized polishing recipe being created based on a target polishing amount, which is a difference between the film thickness profile of the substrate before the first polishing and the target film thickness of the substrate, and the response model for the first polishing, and causes the substrate to be transferred, after performing the first polishing to the polishing unit having the film thickness sensor, to obtain a film thickness profile of the substrate after the first polishing by use of the film thickness sensor, and causes a next wafer to be first polished with a new optimized polishing recipe for first polishing which is created based on a target polishing amount of the next substrate, and a response model corrected by use of the optimized polishing recipe for the first polishing and film thickness profiles of the substrate before and after the first polishing.

In one embodiment, there is provided a polishing apparatus, comprising: a plurality of polishing units each including a polishing table for supporting a polishing pad, a substrate holder for pressing, a substrate against the polishing pad, and a film thickness sensor for measuring a film thickness profile of the substrate; and a controller configured to control at least operation of the polishing units, wherein the substrate holder includes: an elastic membrane film to form a plurality of pressure chambers for pressing the substrate; a head body to which the elastic membrane is attached; and a retainer ring arranged so as to surround the substrate, the substrate is a substrate which is polished by a plurality of polishing processes including a first polishing and a second polishing performed in the polishing unit different from the polishing unit in which the first polishing has been performed, the controller stores in advance a response model for the first polishing and a response model for the second polishing which is created by taking into consideration variation in the amount of polishing between monitored areas of the substrate due to variations in a pressure of a, pressurized fluid supplied to each of the pressure chambers, and the controller causes the substrate to be transferred to any one of the plurality of polishing units to obtain a film thickness profile of the substrate before the first polishing, causes the substrate to be first polished with an optimized polishing recipe for the first polishing including at least the pressurises of the pressurized fluid supplied to each of the plurality of pressure chambers and the polishing time, the optimized polishing recipe being created based on a target polishing amount, which is a difference between the film thickness profile of the substrate before the first polishing and the target film thickness of the substrate, and the response model for the first polishing, obtains a film thickness profile of the substrate before the second polishing by use of the film thickness sensor, causes the substrate to be second polished with an optimized polishing recipe for the second polishing including at least the pressures of the pressurized fluid supplied to each of the plurality of pressure chambers and the polishing time, the optimized polishing recipe being created based on a target polishing amount, which is a difference between the film thickness profile of the substrate before the second polishing and the target film thickness of the substrate, and the response model for the second polishing, and obtains a film thickness profile of the substrate after the second polishing by use of film thickness sensor, causes a next substrate to be polished with a new optimized polishing recipe for first polishing which is created based on a target polishing amount of the next substrate, and a response model corrected by use of the optimized polishing recipe for the first polishing and film thickness profiles of the substrate before and after the first polishing causes the next substrate to be second polished with a new optimized polishing recipe for the second polishing which is created based on a target polishing amount of the next substrate, and a response model corrected by use of the optimized polishing recipe for the second polishing and film thickness profiles of the substrate before and after the second polishing.

In one embodiment, there is provided a polishing method in which a substrate held by a substrate holder is pressed against a polishing pad supported by a polishing table to thereby be polished, the substrate holder including an elastic membrane film to form a plurality of pressure chambers for pressing the substrate, a head body to which the elastic membrane is attached, and a retainer ring arranged so as to surround the substrate, comprising: obtaining a film thickness profile of the substrate before polishing by use of a film thickness measuring device; polishing the substrate with an optimized polishing recipe including at least the pressures of the pressurized fluid supplied to each of the plurality of pressure chambers and the polishing time, the optimized polishing recipe being created based on the response model and a target polishing amount, which is a difference between the film thickness profile of the substrate before polishing and the target film thickness of the substrate; and polishing; a next substrate with a new optimized polishing recipe which is created based on a target polishing amount of the next substrate and a response model corrected by use of the optimized polishing recipe and film thickness profiles of the substrate before and after polishing, wherein the response model is created by taking into consideration variation in the amount of polishing between monitored areas of the substrate, due to variations in a pressure of a pressurized fluid supplied to each of the pressure chambers.

In one embodiment, the optimal polishing recipe is created using an optimization calculation that minimizes an objective function including at least a term for difference between the target polishing amount and a predicted polishing amount calculated using the response model.

In one embodiment, the objective function includes a term for differences between pressures of the pressurized fluid of the optimized polishing recipe and preset reference pressures of the pressurized fluid, and/or a term for differences between the pressures of the pressurized fluid of the optimized polishing recipe and pressures of the pressurized fluid used in polishing of the previous substrate.

In one embodiment, the optimization calculation is quadratic programming method.

In one embodiment, the number of the plurality of monitored areas is greater than the number of the plurality of pressure chambers.

In one embodiment, the response model is a response model created by further taking into consideration variation in an amount of polishing between the monitored areas of the substrate due to variation in a pressing force of a retaining ring on the polishing pad, and the optimized polishing recipe further includes the pressing force of the retainer ring.

In one embodiment, the film thickness measuring device is configured to measure a film thickness at a plurality of measurement points set in each of the plurality of monitored areas.

In one embodiment, the response model includes a response coefficient representing an amount of increase in the polishing rate per unit polishing pressure in each of the plurality of monitored areas.

In one embodiment, the response model is created by further taking into consideration variation in an amount of polishing between the monitored areas due to variation in the local load applied to a part of the retainer ring by a plurality of local-load exerting devices.

In one embodiment, there is provided a polishing method in which a substrate held by a substrate holder is pressed against a polishing pad supported by a polishing table to thereby be polished, the substrate holder including an elastic membrane film to form a plurality of pressure chambers for pressing the substrate, a head body to which the elastic membrane is attached, and a retainer ring arranged so as to surround the substrate, comprising: storing in advance film thickness profiles of a plurality of substrates before polishing and response models for polishing each of the plurality of substrates, the response models being created by taking into consideration variation in the amount of polishing between monitored areas of the substrate due to variations in a pressure of each of the pressure chambers, classifying in advance the film thickness profiles of the plurality of substrates before polishing into a plurality of groups to which the film thickness profiles similar to each other belong, obtains a film thickness profile of the substrate before polishing by use of the film thickness measuring device to determine a group, to which the film thickness profile of the substrate before polishing belongs, from the plurality of groups, polishing the substrate with an optimized polishing recipe including at least the pressures of the pressurized fluid supplied to each of the plurality of pressure chambers and the polishing time, the optimized polishing recipe being created based on a target polishing amount, which is a difference between the film thickness profile of the substrate before polishing and the target film thickness of the substrate, and a response model associated with the determined group, and polishing a next substrate with a new optimized polishing recipe which is created based on a target polishing amount of the next substrate, and a response model corrected by use of the optimized polishing recipe and film thickness profiles of the substrate before and after polishing.

In one embodiment, there is provided a polishing method in which a substrate is polished by a plurality of polishing process performed in a plurality of polishing unit each including a polishing table for supporting a polishing pad and a substrate holder for pressing a substrate against the polishing pad, wherein the substrate holder includes: an elastic membrane film to form a plurality of pressure chambers for pressing the substrate; a head body to which the elastic membrane is attached; and a retainer ring arranged so as to surround the substrate, the plurality of polishing processes includes a first polishing and a second polishing performed in the polishing unit different from the polishing unit in which the first polishing has been performed, the polishing unit performing the first polishing has a film thickness sensor for measuring a film thickness profile of the substrate, and the polishing method comprising: preparing in advance a response model for the second polishing which is created by taking into consideration variation in the amount of polishing between monitored areas of the substrate due to variations in a pressure of a pressurized fluid supplied to each of the pressure chambers; obtaining, after performing the first polishing, a film thickness profile of the substrate before the second polishing by use of the film thickness sensor; second polishing the substrate with an optimized polishing recipe for the second polishing including at least the pressures of the pressurized fluid supplied to each of the plurality of pressure chambers and the polishing time, the optimized polishing recipe being created based on a target polishing amount, which is a difference between the film thickness profile of the substrate before the second polishing and the target film thickness of the substrate, and the response model for the second polishing; and second polishing a next substrate with a new optimized polishing recipe for the second polishing which is created based on a target polishing amount of the next substrate, and a response model corrected by use of the optimized polishing recipe for the second polishing and film thickness profiles of the substrate before and after the second polishing.

In one embodiment, there is provided a polishing method in which a substrate is polished by a plurality of polishing process performed in a plurality of polishing unit each including a polishing table for supporting a polishing pad, and a substrate holder for pressing a substrate against the polishing pad, wherein the substrate holder includes: an elastic membrane film to form a plurality of pressure chambers for pressing the substrate; a head body to which the elastic membrane is attached; and a retainer ring arranged so as to surround the substrate, the plurality of polishing processes includes a first polishing and a second polishing performed in the polishing unit different from the polishing unit in which the first polishing has been performed, the polishing unit performing the second polishing has a film thickness sensor for measuring a film thickness profile of the substrate, and the polishing method comprising: preparing in advance a response model for the first polishing which is created by taking into consideration variation in the amount of polishing between monitored areas of the substrate due to variations in a pressure of a pressurized fluid supplied to each of the pressure chambers; obtaining a film thickness profile of the substrate before the first polishing by use of the film thickness sensor; first polishing the substrate with an optimized polishing recipe for the first polishing including at least the pressures of the pressurized fluid supplied to each of the plurality of pressure chambers and the polishing time, the optimized polishing recipe being created based on a target polishing amount, which is a difference between the film thickness profile of the substrate before the first polishing and the target film thickness of the substrate, and the response model for the first polishing, and transferring, after performing the first polishing, the substrate to the polishing unit having the film thickness sensor, obtaining a film thickness profile of the substrate after the first polishing by use of the film thickness sensor, and first polishing a next wafer with a new optimized polishing recipe for first polishing which is created based on a target polishing amount of the next substrate, and a response model corrected by use of the optimized polishing recipe for the first polishing and film thickness profiles of the substrate before and after the first polishing.

In one embodiment, there is provided a polishing method in which a substrate is polished by a plurality of polishing process performed in a plurality of polishing unit each including a polishing table for supporting a polishing pad, and a substrate holder for pressing a substrate against the polishing pad, wherein the substrate holder includes: an elastic membrane film to form a plurality of pressure chambers for pressing the substrate; a head body to which the elastic membrane is attached; and a retainer ring arranged so as to surround the substrate, the plurality of polishing processes includes a first polishing and a second polishing performed in the polishing unit different from the polishing unit in which the first polishing has been performed, each of the polishing unit performing the first polishing and the polishing unit performing the second polishing has a film thickness sensor for measuring a film thickness profile of the substrate, and the polishing method comprising: preparing in advance a response model for the first polishing and a response model for the second polishing which is created by taking into consideration variation in the amount of polishing between monitored areas of the substrate due to variations in a pressure of a pressurized fluid supplied to each of the pressure, chambers, and transferring the substrate to the polishing unit for performing the first polishing to obtain a film thickness profile of the substrate before the first polishing, first polishing the substrate with an optimized polishing recipe for the first polishing including at least the pressures of the pressurized fluid supplied to each of the plurality of pressure chambers and the polishing time, the optimized polishing recipe being created based on a target polishing amount, which is a difference between the film thickness profile of the substrate before the first polishing and the target film thickness of the substrate, and the response model for the first polishing, obtaining a film thickness profile of the substrate before the second polishing by use of the film thickness sensor, second polishing the substrate with an optimized polishing recipe for the second polishing including at least the pressures of the pressurized fluid supplied to each of the plurality of pressure chambers and the polishing time, the optimized polishing recipe being created based on a target polishing amount, which is a difference between the film thickness profile of the substrate before the second polishing and the target film thickness of the substrate, and the response model for the second polishing, and obtaining a film thickness profile of the substrate after the second polishing by use of film thickness sensor, first polishing a next substrate to be polished with a new optimized polishing recipe for first polishing which is created based on a target polishing amount of the next substrate, and a response model corrected by use of the optimized polishing recipe for the first polishing and film thickness profiles of the substrate before and after the first polishing, and second polishing the next substrate to be second polished with a new optimized polishing recipe for the second polishing which is created based on a target polishing amount of the next substrate, and a response model corrected by use of the optimized polishing recipe for the second polishing and film thickness profiles of the substrate before and after the second polishing.

According to the above-described embodiments, the optimized polishing recipe obtained by use of the response model takes into account variation in the amount of polishing between the areas of the substrate due to the variation the pressures in each of the pressure chambers change. Therefore, the film thickness profile of the substrate can be controlled more precisely.

BRIEF DESCRIPTION OF THE DRAWINGS

FIG. 9 is a view showing an example of matrices C, D, R, and X in a response model;

FIG. 10 is a view showing an example of matrices C', and X' in the response model;

DESCRIPTION OF EMBODIMENTS

Embodiments according to the above-described embodiments will be described in detail below with reference to the drawings.

Figure 1:
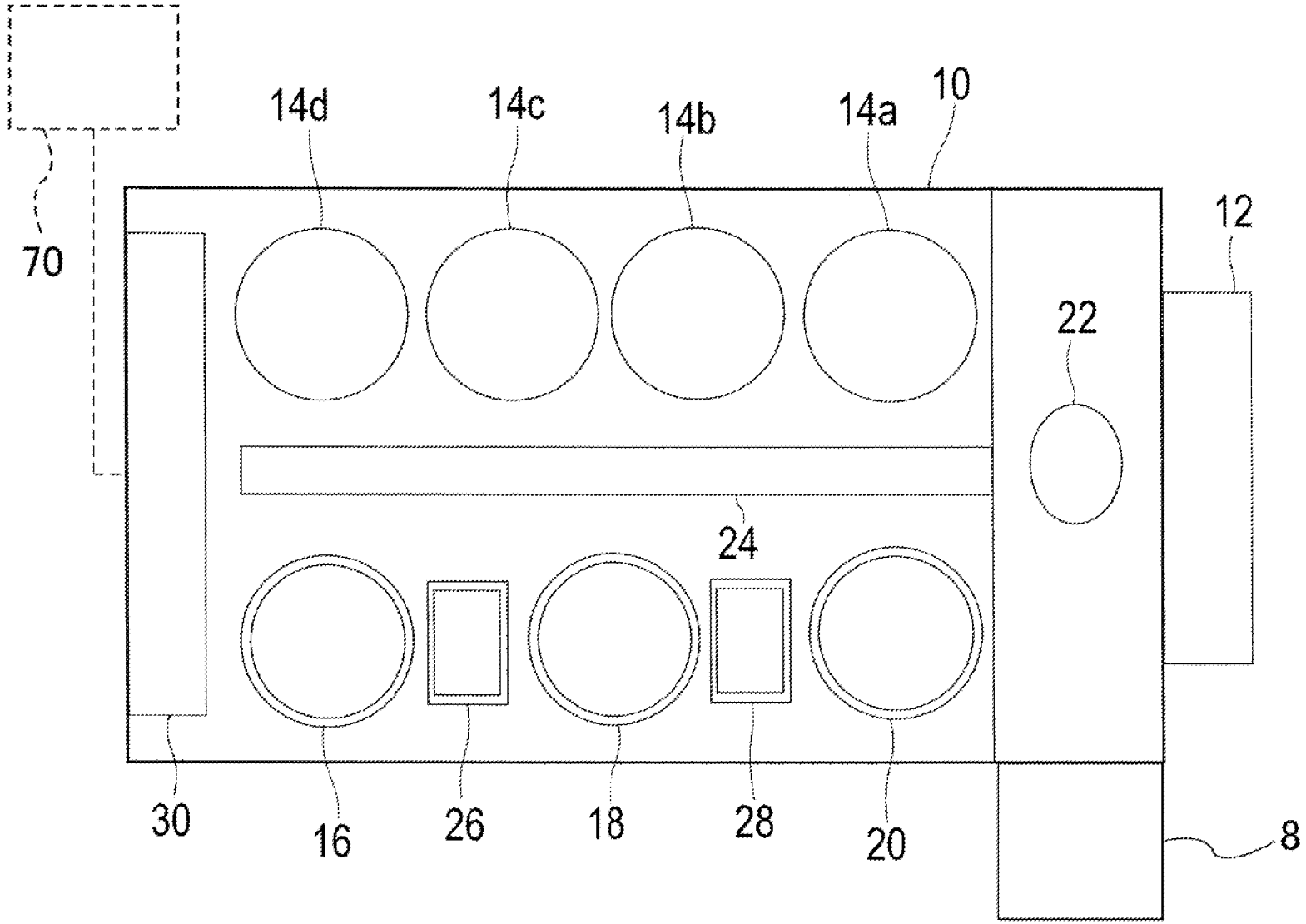
FIG. 1 is a plan view showing an entire configuration of a substrate processing apparatus according to an embodiment.

FIG. 1 is a schematic view showing an entire configuration of a polishing apparatus according to an embodiment. The polishing apparatus shown in FIG. 1 is a CMP apparatus that performs a series of polishing processes: polishing a surface of a wafer, which is an example of a substrate; cleaning the polished water; and drying the cleaned wafer.

As shown in FIG. 1, the polishing apparatus includes an approximately-rectangular housing 10, and a loading port 12 on which a substrate cassette is placed. The substrate cassette houses therein a large number of wafers (substrates). The loading port 12 is disposed adjacent to the housing 10. The loading port 12 can be mounted with an open cassette, a SMIF (Standard Manufacturing Interface) pod, or a FOUP (Front Opening Unified Pod). Each of the SMIF and the FOUP is an airtight container which houses a substrate cassette therein and which, by covering it with a partition wall, can keep its internal environment isolated from an external environment.

In the housing 10, there are disposed a plurality of (four in this embodiment) polishing units 14*a* to 14*d* each for polishing the wafer, a first cleaning unit 16 and a second cleaning unit 18 each for cleaning a polished wafer, and a drying unit 20 for drying a cleaned wafer. The polishing units 14*a* to 14*d* are arranged along a longitudinal direction of the polishing apparatus, and the cleaning units 16, 18 and the drying unit 20 are also arranged along the longitudinal direction of the polishing apparatus. Further, the polishing apparatus has a controller 30, which is disposed in the housing 10, and is configured to control operations of each of units.

A first substrate transfer robot 22 is disposed in an area surrounded by the loading port 12, the polishing unit 14*a*, and the drying unit 20. Further, a substrate transport device 24 is disposed parallel to the polishing units 14*a* to 14*d*. The first substrate transfer robot 22 receives a wafer, to be polished, from the loading port 12 and transfers the wafer to the substrate transport device 24, and receives a dried wafer from the drying unit 20 and returns the dried wafer to the loading port 12. The substrate transport device 24 transports a wafer received from the first substrate transfer robot 22, and transfers the substrate between the polishing units 14*a*, 14*b*, 14*c*, 14*d*.

A second substrate transfer robot 26 for transferring a substrate between the cleaning units 16, 18 and the substrate transport device 24 is provided between the first cleaning unit 16 and the second cleaning unit 18. A third substrate transfer robot 28 for transferring a substrate between the second cleaning unit 18 and the drying unit 20 is provided between these units 18, 20. Further, an operation controller 30 for controlling operations of each unit of the substrate processing apparatus is provided in the housing 10. The first substrate transfer robot 22, the substrate transport device 24, the second substrate transfer robot 26, and the third substrate transfer robot 28 constitute a substrate transfer unit for transferring the wafer between the polishing units 14*a* to 14*d*, the cleaning units 16, 18, and the drying unit 20.

In this embodiment, the first cleaning unit 16 is a substrate cleaning apparatus configured to clean a wafer by scrubbing both a front surface and a rear surface of the wafer with roll sponges, in the presence of a chemical liquid. The second cleaning unit 18 is a substrate cleaning apparatus in which a pen-type sponge (pen sponge) is used. In one embodiment, the second cleaning unit 18 may be a substrate cleaning apparatus configured to clean a substrate by scrubbing both a front surface and a rear surface of the substrate with roll sponges in the presence of a chemical liquid. Further, the drying unit 20 is a spin drying apparatus configured to hold a substrate, eject IPA vapor from a moving nozzle to dry the substrate, and rotate the substrate at a high velocity to further dry the substrate.

The wafer is polished by at least one of the polishing units 14*a* to 14*d*. The polished wafer is cleaned by the first cleaning unit 16 and the second cleaning unit 18, and the cleaned substrate is then dried by the drying unit 20. In one embodiment, the polished wafer may be cleaned by either the first cleaning unit 16 or the second cleaning unit 18.

As shown in FIG. 1, the polishing apparatus according to this embodiment has a film thickness measuring device (ITM: In-line Thickness Monitor) 8 for detecting (measuring) a film thickness profile of a surface of the wafer (surface to be polished). The type of the film thickness measuring device 8 is free-selected as long as it is capable of acquiring the thickness profile of the wafer. For example, the film thickness measuring device 8 may be a measuring device that employs a non-contact detection method, such as an eddy current type, or optical type, or may be a measuring device that detects the film thickness profile through a detection head scanning above the wafer in a non-contact manner. Alternatively, the film thickness measuring device 8 may be a measuring device that scans a probe in contact with the surface of the wafer and monitors vertical movement of the probe to thereby detect a distribution of irregularities on the surface of the water. In both contact and non-contact detection methods, output to be detected is a signal of film thickness, or a signal corresponding to film thickness. When detecting the film thickness profile of the wafer, a notch position or an orientation flat position of the wafer may be used as a reference to relate the film thickness profile not only to the radial position but also to the circumferential position.

The film thickness measuring device 8 is connected to a controller 30, and the controller 30 is configured to control operation of the film thickness measuring device 8. Further, the film thickness measuring device 8 transmits measured values thereof to the controller 30, and the controller 30 can acquire the film thickness profile of the wafer from the measured values transmitted from the film thickness measuring device 8.

Figure 2:
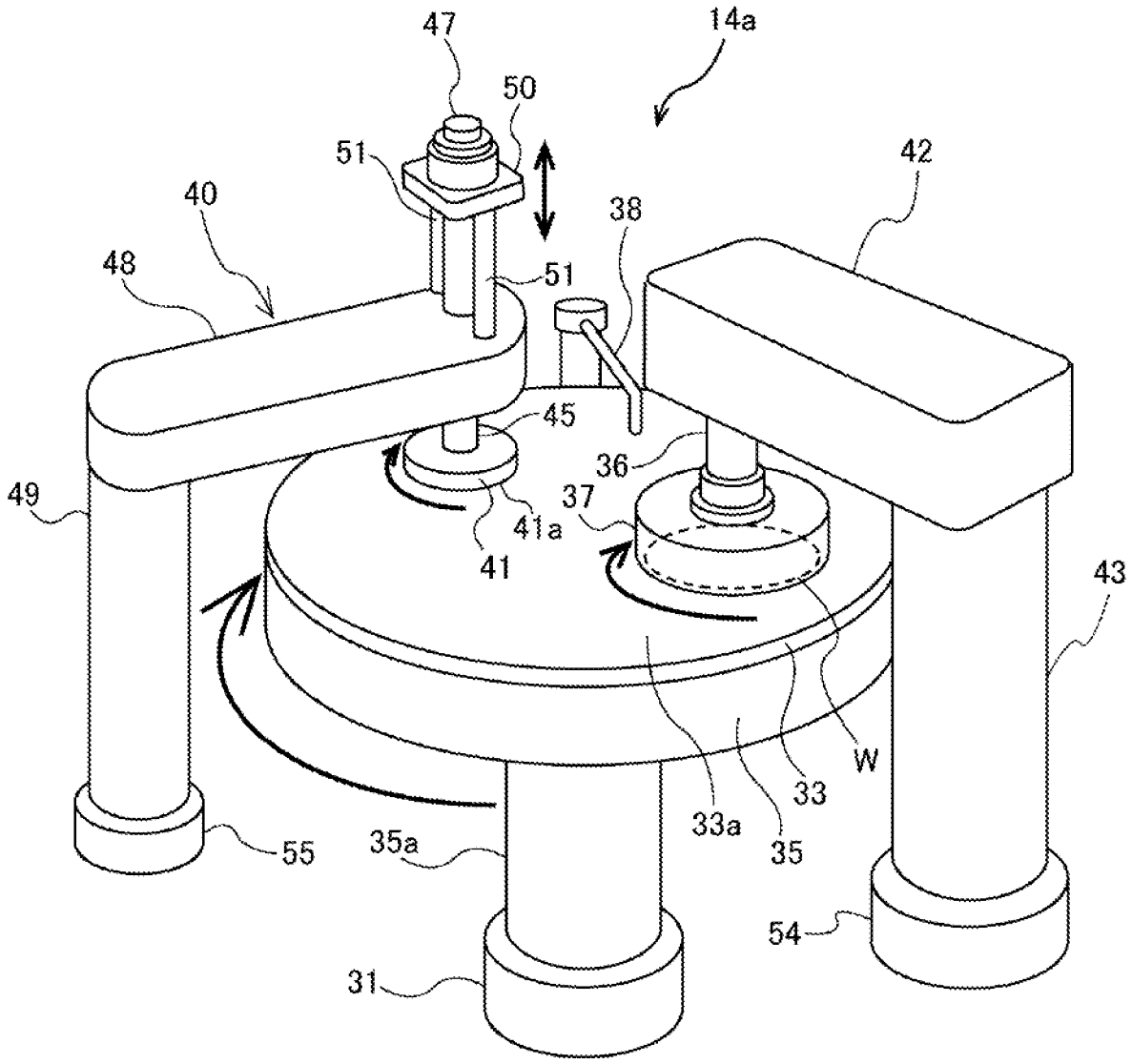
FIG. 2 is a perspective view schematically showing an example of an polishing unit shown in FIG. 1.

FIG. 2 is a perspective view schematically showing an example of the polishing unit 14*a* shown in FIG. 1. The polishing units 14*a* to 14*d* shown in FIG. 1 have the same configuration as each other, and the polishing unit 14*a* will be described below.

The polishing unit 14*a* shown in FIG. 2 includes a polishing table 35 to which a polishing pad 33 having a polishing surface 33*a* is attached, a polishing head 37 for holding the wafer W, and pressing the wafer W against the polishing pad 33 on the polishing table 35, a polishing-liquid supply nozzle 6 for supplying a polishing liquid and a dressing liquid (e.g., pure water) onto the polishing pad 10, and a dressing apparatus 40 having a dresser 41 for dressing the polishing surface 33*a* of the polishing pad 33.

The polishing table 35 is coupled to a table motor 31 through a table shaft 35*a*, so that the polishing table 35 is rotated by this table motor 31 in a direction indicated by arrow. The table motor 31 is located below the polishing table 3. The polishing pad 33 is attached to an upper surface of the polishing table 35. The polishing pad 33 has an upper surface, which provides a polishing surface 33*a* for polishing the wafer. The polishing head 37 is coupled to a lower end of a head shaft 36. The polishing head 37 is configured to be able to hold the wafer on its lower surface by vacuum suction. The head shaft 36 is elevated and lowered by an elevating mechanism (not shown).

The head shaft 36 is rotatably supported to a head arm 42. The head arm 42 is actuated by a head pivot motor 54 to pivot on a head pivot shaft 43. When the head pivot motor 54 is set in motion, the polishing head 37 is moved between a polishing position above polishing pad 33, and a standby position beside the polishing pad 33.

The dressing apparatus 40 includes a dresser 41 which is brought into sliding contact with the polishing pad 33, a dresser shaft 45 to which the dresser 41 is coupled, a pneumatic cylinder 47 mounted to an upper end of the dresser shaft 45, and a dresser arm 27 for rotatably supporting the dresser shaft 23. A lower surface of the dresser 41 serves as a dressing surface 41*a*, and this dressing surface 41*a* is formed by abrasive grains (e.g., diamond particles). The pneumatic cylinder 47 is disposed on a support base 50 which is supported by a plurality of columns 51, and these columns 51 are fixedly mounted to the dresser arm 48.

The dresser arm 48 is actuated by a dresser pivot motor 55 to pivot on a dresser pivot shaft 49. The dresser shaft 45 is rotated about its own axis by an actuation of a motor (not shown), thus rotating the dresser 41 about the dresser shaft 45 in a direction indicated by arrow. The pneumatic cylinder 47 serves as an actuator for moving the dresser 41 vertically through the dresser shaft 45 and for pressing the dresser 41 against the polishing surface (surface) 33*a* of the polishing pact 33 at a predetermined force.

Figure 3:
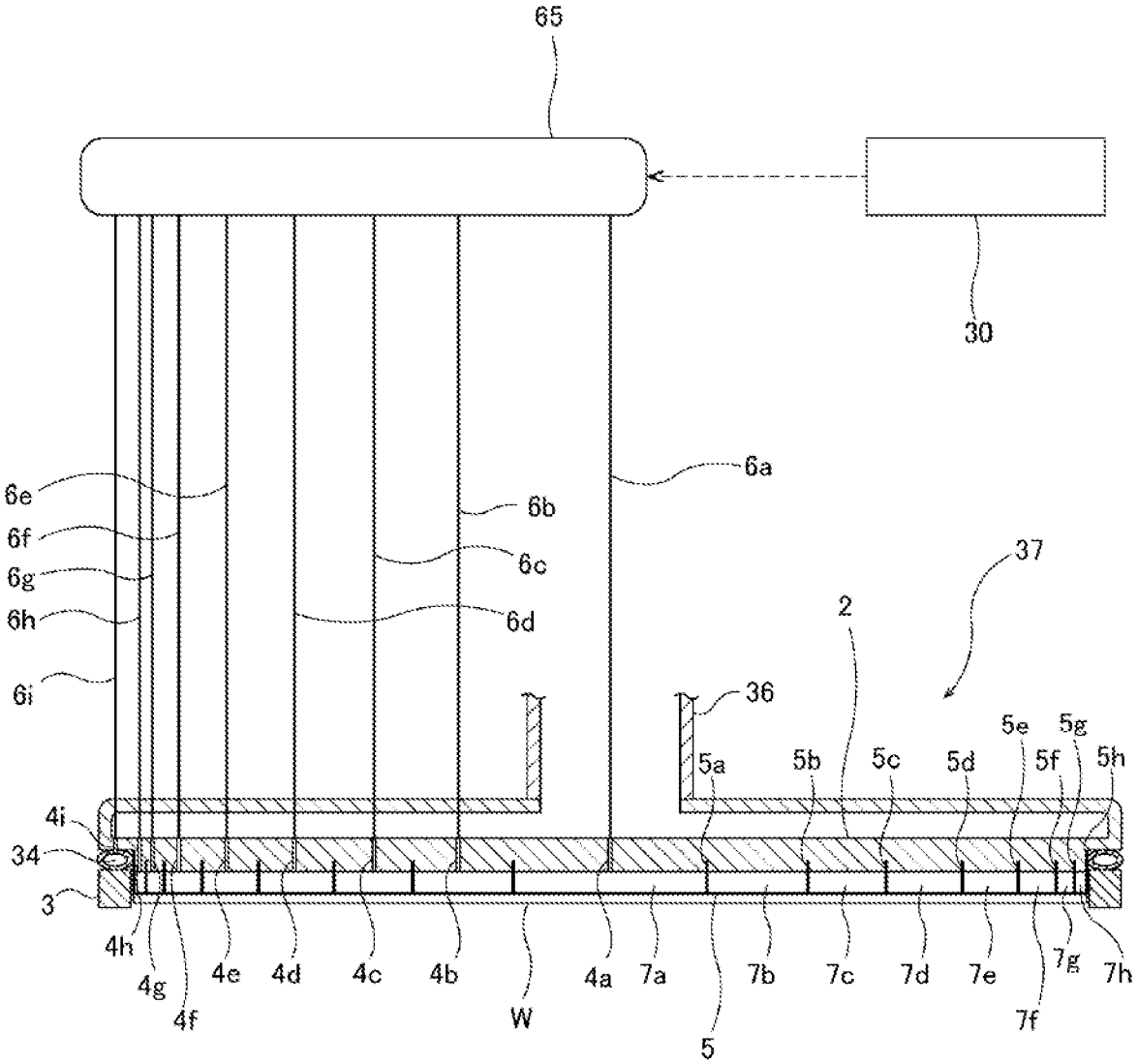
FIG. 3 is a cross-sectional view schematically showing an example of a polishing head.

Next, an example of the polishing head 37, which is installed in the polishing unit 14*a*, will be described with reference to FIG. 3. FIG. 3 is a cross-sectional view schematically showing an example of the polishing head. As shown in FIG. 3, the polishing head 37 basically comprises a head body 2 which is secured to a lower end of the head shaft 36, a retaining ring 3 for directly pressing the polishing surface 33*a* (see FIG. 2), and an elastic membrane (membrane) 5 for pressing the wafer W against the polishing surface 33*a*. The retaining ring 3 is disposed so as to surround the wafer W, and is coupled to the head body 2. The elastic membrane 5 is attached to the head body 2 so as to cover a lower surface of the head body 2.

The elastic membrane 5 has a plurality of (eight in the drawing) annular circumferential walls 5*a*, 5*b*, 5*c*, 5*d*, 5*e*, 5*f*, 5*g* and 5*h* which are arranged concentrically. These circumferential walls 5*a* to 5*h* form a circular central pressure chamber 7*a* located at a center of the elastic membrane 5, an annular edge pressure chamber 7*h* located at the outermost part of the elastic membrane 5, and six annular intermediate pressure chambers (i.e., first to sixth intermediate pressure chambers) 7*b*, 7*c*, 7*d*, 7*e*, 7*f*, and 7*g* located between the central pressure chamber 7*a* and the edge pressure chamber 7*h*. These pressure chambers 7*a* to 7*h* are located between an upper surface of the elastic membrane 5 and the lower surface of the head body 2. In the present embodiment, the number of pressure chambers formed by the elastic membrane 5 is eight, but the number of pressure chambers is not limited to the present embodiment. The number of pressure chambers may be, increased or decreased according to the configuration of the elastic membrane 5.

The head body 2 has fluid passages 4*a*, 4*b*, 4*c*, 4*d*, 4*e*, 4*f*, 4*g*, and 4*h* formed therein, which communicate with the pressure chambers 7*a* to 7*h*, respectively. These fluid passages 4*a*, 4*b*, 4*c*, 4*d*, 4*e*, 4*f*, 4*g*, and 4*h* are coupled to a pressure regulating device 65 through fluid lines 6*a*, 6*b*, 6*c*, 6*d*, 6*e*, 6*f*, 6*g*, and 6*h*, respectively. The pressure regulating device 65 is connected to the controller 30, and thus the controller 30 can control the pressure regulating device 65.

A retainer chamber 34 is formed immediately above the retaining ring 3. This retainer chamber 34 is coupled to the pressure regulating device 65 through a fluid passage 4*i* formed in the head body 2 and a fluid line 6*i*.

According to the polishing head 37 configured as shown in FIG. 3, pressures of the pressurized fluid supplied to each of the pressure chambers 7*a* to 7*h* are controlled in a state where the wafer W is held by the polishing head 37, so that the polishing head 37 can press the wafer W with different pressures that are transmitted through multiple areas of the elastic membrane 5 arrayed along a radial direction of the wafer W. Thus, in the polishing head 37, pressing forces applied to the wafer W can be adjusted at multiple zones of the wafer W by adjusting pressures of the pressurized fluid supplied to each of the pressure chambers 7*a* to 7*h* formed between the head body 2 and the elastic membrane 5. At the same time, a pressing force for pressing the polishing pad 33 (see FIG. 2) by the retaining ring 3 can be adjusted by adjusting a pressure of the pressurized fluid supplied to the retainer chamber 34.

With the retaining ring 3 pressing the polishing pad 33, a shape of the pad 33 changes in response to the pressing force thereof. Therefore, the pressing force of the retainer ring 3 on the polishing pad 33 is also a factor that affects the film thickness profile of the wafer W after polishing.

The retaining ring 3 is made of resin, such as engineering plastic (e.g., PEEK), and the elastic membrane 5 is made of a highly strong and durable rubber material, such as ethylene propylene rubber (EPDM), polyurethane rubber, silicone rubber, or the like.

Figure 4:
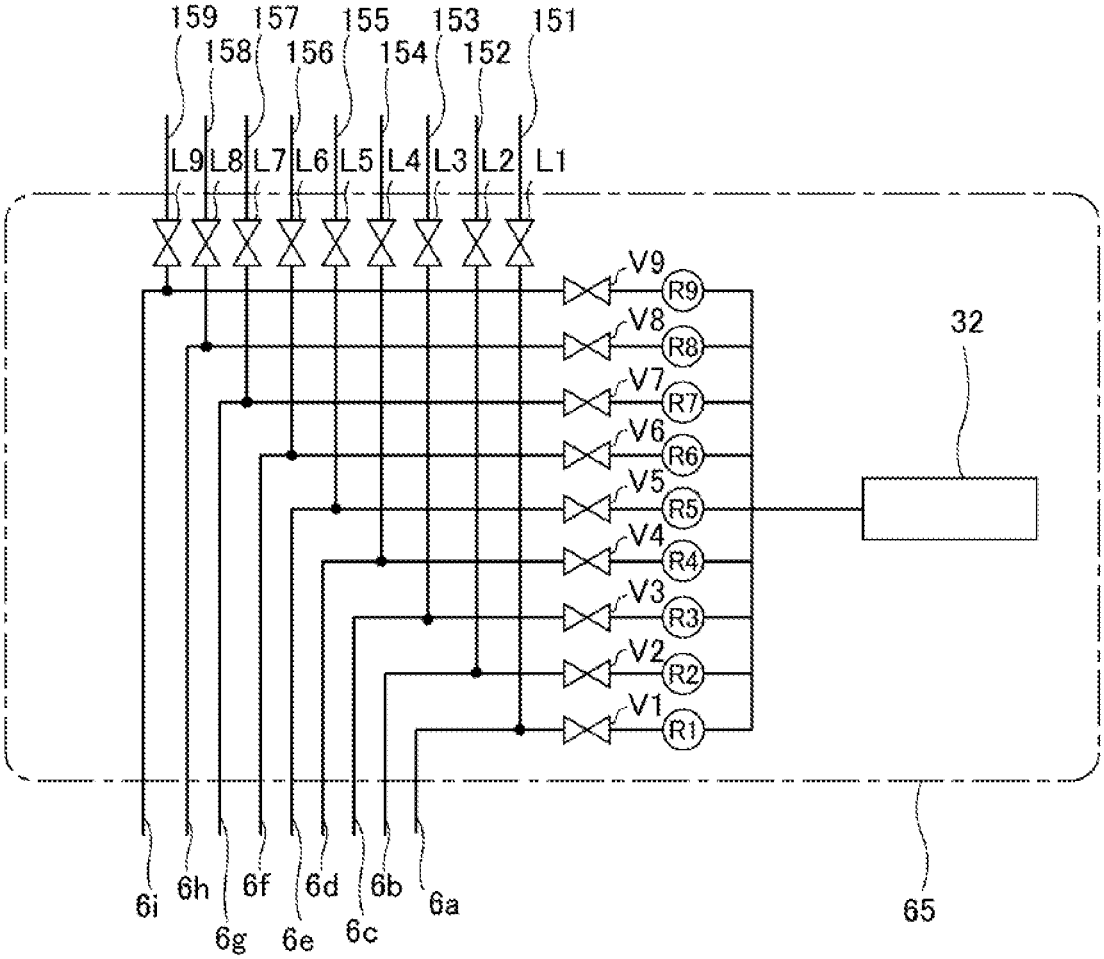
FIG. 4 is a schematic view showing a pressure regulating device shown in FIG. 3.

Next, configuration of the pressure regulating device 65 shown in FIG. 3 will be described with reference to FIG. 4. FIG. 4 is a schematic view showing the pressure, regulating device 65 shown in FIG. 3. As shown in FIG. 4, opening and closing valves V1, V2, V3, V4, V5, V6, V7, V8 and V9, and pressure regulators R1, R2, R3, R4, R5, R6, R7, R8 and R9 are provided respectively in the fluid lines 6*a* to 6*i*. The fluid passages 4*a*, to 4*i* are coupled to a fluid supply source 32 through the fluid lines 6*a* to 6*i*, respectively.

Further, pressure release lines 151 to 159 are coupled to the fluid lines 6*a* to 6*i*, respectively. Pressure release valves L1 to L9 are attached to the pressure release lines 151 to 159, respectively.

The pressure regulators R1 to R9 have a pressure regulating function for regulating pressures of the pressurized fluid supplied from the fluid supply source 32 to the pressure chambers 7*a* to 7*h* and the retainer chamber 34, respectively. The pressure regulators R1 to R9, the opening and closing valves V1 to V9, and the pressure release valves L1 to L9 are connected to the controller 30, and thus operations of these pressure regulators and these, valves are controlled by the controller 30. When the pressure release valves L1 to L9 are operated, each of the chambers 7*a* to 7*h* and 34 are open to the atmosphere and become atmospheric pressure.

Although not shown in the drawing, vacuum lines are coupled to the fluid lines 6*a* to 6*i*, respectively, and negative pressure is formed in each chambers 7*a* to 7*h* and 34 through these vacuum lines. Thus, each chambers 7*a*, to 7*h* and 34 is regulated into one of pressurized state, negative pressure state, and atmospheric pressure state by the pressure regulating device 65.

When a vacuum is formed in any of the intermediate pressure chambers 7*b* to 7*g* (for example, the intermediate pressure chamber 7*d*) in a state where the wafer W is placed in contact with the lower surface of the elastic membrane 5, the wafer W is held by the polishing head 37 by vacuum attraction. Further, when the pressurized fluid is supplied to any of the intermediate pressure chambers 7*b* to 7*g* (for example, the intermediate pressure chamber 7*d*) in a state where the wafer W is separated from the polishing pad 33, the wafer W is released from the polishing head 37.

Figure 5:
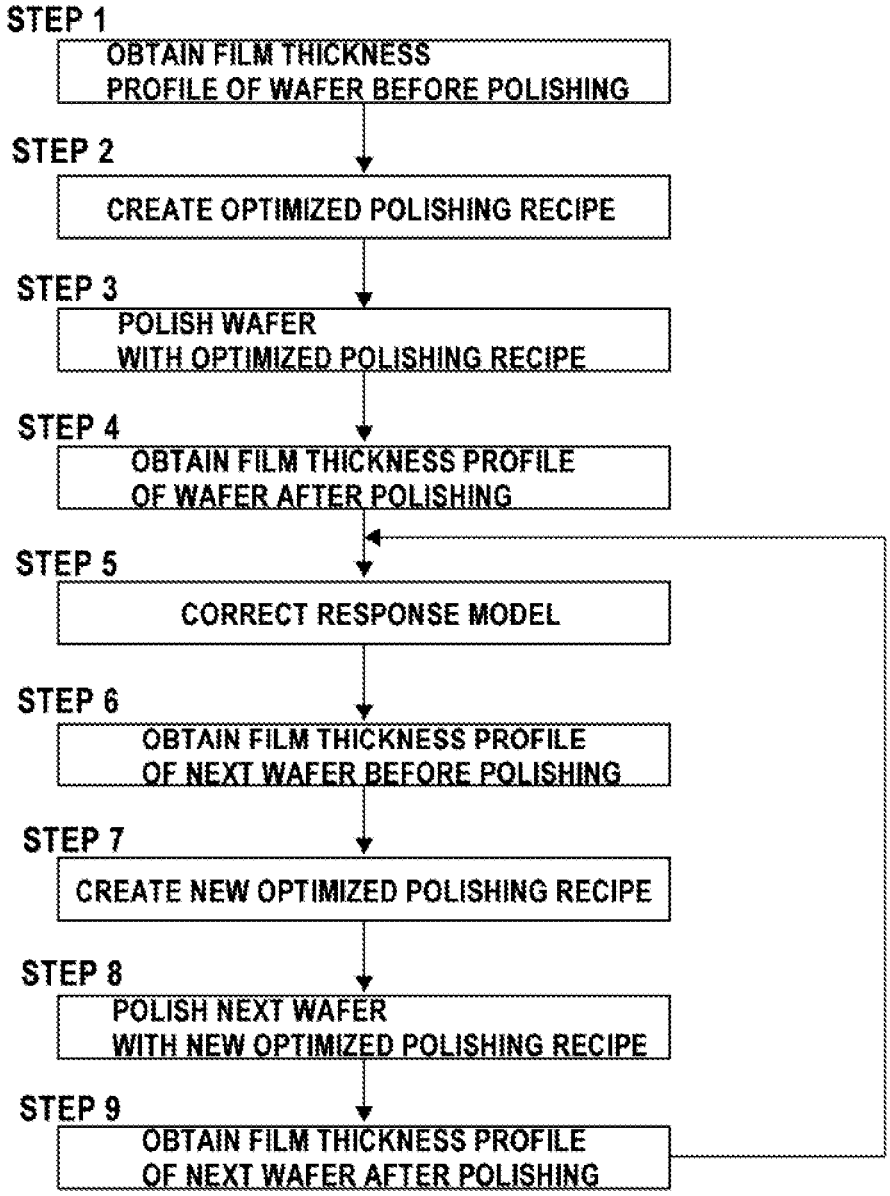
FIG. 5 is a flowchart showing a polishing method according to an embodiment.

Next, a polishing method for polishing the wafer W using this polishing apparatus will be described. FIG. 5 is a flowchart showing a polishing method according to an embodiment. As shown in FIG. 5, the controller 30 of the polishing apparatus causes a wafer W to be taken out from the substrate cassette placed on the load port 12 (see FIG. 1) to be transferred to the film thickness measuring device 8, and obtains a film thickness profile of the wafer W before polishing (see STEP 1 in FIG. 5).

Next, the controller 30 creates an optimized polishing recipe based on the film thickness profile of the wafer W before polishing and a response model (see STEP 2 in FIG.

5). The response model is stored in the controller 30 in advance. A method of preparing this response model will be described later.

In the following, a method of creating the optimized polishing recipe according to an embodiment is described.

First, the controller 30 calculates initial film thicknesses for each of monitored areas in the wafer W, corresponding to each of the pressure chambers 7*a*, to 7*h* of the elastic membrane 5, from the film thickness profile of the wafer W before polishing, which has been acquired by the film thickness measuring device 8. Hereinafter, for convenience of explanation, the monitored area in the wafer W which corresponds to the pressure chamber 7*a* is represented as Da, and the initial film thickness in the monitored area Da is represented as Ta. Similarly, the monitored area in wafer W which corresponds to the pressure chamber 7*b* is represented as Db, and the initial film thickness in the monitored area Db is represented as Tb. The monitored area, in wafer W which corresponds to the pressure chamber 7*c* is represented as Dc, and the initial film thickness in the monitored area Dc is represented as Tc. The monitored area in wafer W which corresponds to the pressure chamber 7*d* is represented as Dd, and the initial film thickness in the monitored area Dd is represented as Td. The monitored area, in wafer W which corresponds to the pressure chamber 7*e* is represented as De, and the initial film thickness in the monitored area De is represented as Te. The monitored area in wafer W which corresponds to the pressure chamber 7*f* is represented as Df, and the initial film thickness in the monitored area Df is represented as Tf. The monitored area in wafer W which corresponds to the pressure chamber 7*g* is represented as Dg, and the initial film thickness in the monitored area Dg is represented as Tg. The monitored area in wafer W which corresponds to the pressure chamber 7*h* is represented as Dh, and the initial film thickness in the monitored area Dh is represented as Th.

The film thickness measuring device 8 measures the film thicknesses at a plurality of measurement points in each of the monitored areas Da to Dh, and then sends the measured values thereof to the controller 30. The controller 30 determines representative values of the plurality of measured film thickness values in each of the monitored areas Da to Dh as the initial film thicknesses Ta to Th. The representative value is, for example, the average of the plurality of measured film thickness values. Next, the controller 30 calculates differences between each of the initial film thicknesses Ta to Th and a target film thickness Tt, respectively, and calculates target polishing amounts Ra' to Rh' for each of the monitored areas Da to Dh.

Next, the controller 30 uses the response model stored in the controller 30 in advance to calculate predicted polishing amounts Ra to Rh in each of the monitored areas Da to Dh. The controller 30 calculates at least pressures of the pressurized fluid supplied to each of the pressure chambers 7*a* to 7*h* and polishing time by use of optimization calculations, such that the predicted polishing amount Ra to Rh is close to the calculated target polishing amount Ra' to Rh', respectively.

In the optimization calculations, for example, an objective function shown in a following equation (1) is used. In the optimization calculations, the pressures of the pressurized fluid supplied to each of the pressure chambers 7*a* to 7*h* and the retainer chamber 34, and the polishing time are calculated, which minimize the objective function including the differences between the predicted polishing amounts Ra to Rh and the target polishing amounts Ra' to Rh'.

$$\text{Objective function} = \Sigma|\text{Predicted polishing amount} - \text{Target polishing amount}|^2 \quad (1)$$

Although the objective function shown in equation (1) takes into consideration only the polishing amounts, this embodiment is not limited to this example. For example, as shown in a following equation (2), it is also preferred that the objective function include a term for differences between the calculated optimum pressures of the pressurized fluid and the preset reference pressures of the pressurized fluid, and a term for differences between the calculated optimum pressures of the pressurized fluid and the optimum pressures of the pressurized fluid at the previous polishing of the wafer.

$$\text{Objective function} = \Sigma|\text{Predicted polishing amount} - \text{Target polishing amount}|^2 + \lambda\cdot\Sigma|\text{Calculated optimum pressure of pressurized fluid} - \text{Preset reference pressure of pressurized fluid}|^2 + \gamma\cdot\Sigma|\text{Calculated optimum pressure of pressurized fluid} - \text{Optimum pressure of pressurized fluid at previous polishing}|^2 \quad (2)$$

wherein, λ and γ are weight coefficients that determine weights of each term, and can be set to any real number greater than or equal to 0. The addition of these terms prevents the calculated optimum pressures of the pressurized fluid from changing significantly in each wafer to be processed, and thus enables stable optimum polishing conditions to be obtained.

The pressures of the pressurized fluid supplied to each of the pressure chambers 7*a* to 7*h* correspond to the polishing pressures in each of the monitored areas Da to Dh. Further, the pressing force of the retainer ring 3 on the polishing pad 33 corresponds to the pressure of the pressurized fluid supplied to the retainer chamber 34.

Figure 6A:
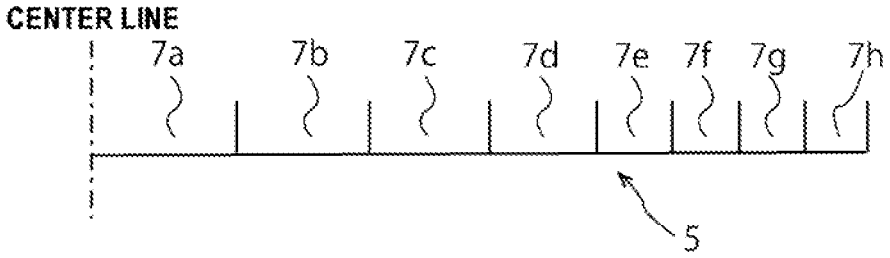
FIG. 6A is a schematic view showing an example of a plurality of pressure chambers.
Figure 6B:
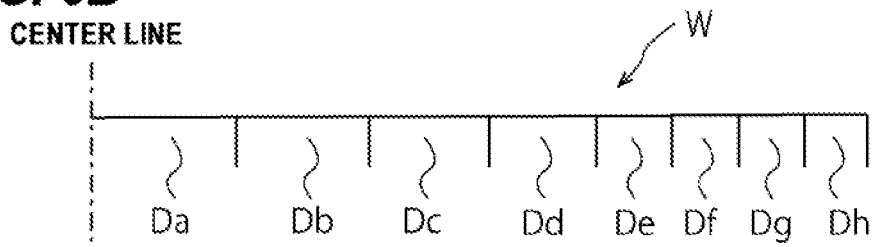
FIG. 6B is a schematic view showing an example of monitored areas of a wafer.
Figure 6C:
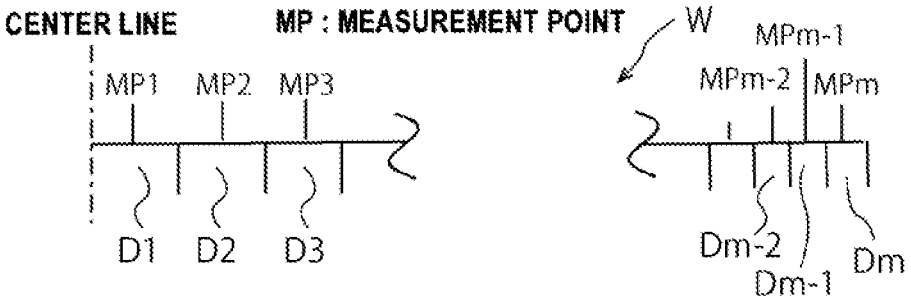
FIG. 6C is a schematic view showing an example of another monitored areas of the wafer.

In this embodiment, the monitored areas of film thickness in the wafer W correspond to each of the pressure chambers 7*a* to 7*h* of the elastic membrane 5, and are divided into a number of areas equal to the total number of pressure chambers of the elastic membrane 5 (see FIGS. 6A and 6B). However, the monitored areas of the film thickness in the wafer W may be further divided into smaller areas. As described above, the film thickness measuring device 8 can measure the film thickness at a plurality of measurement points in each of the monitored areas Da to Dh. Therefore, for example, the monitored areas of the film thickness in the wafer W can be divided into monitored areas D1 to Dm corresponding to each measurement point MP of the film thickness with the film thickness measuring device 8 (see FIGS. 6A and 6C). The subscription "m" corresponds to the number of measurement points.

Figure 6D:
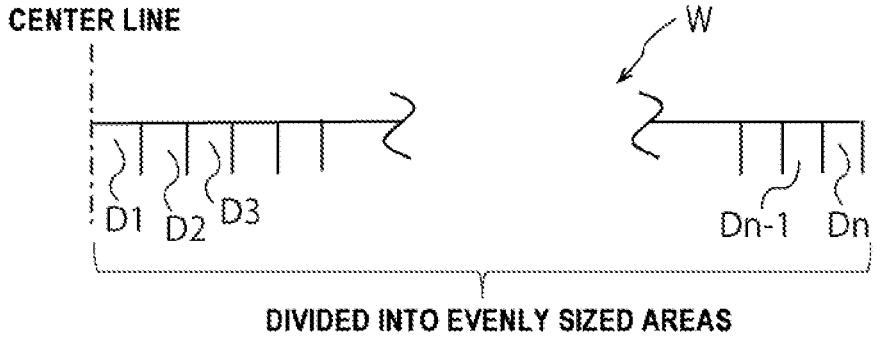
FIG. 6D is a schematic view showing an example of still another monitored areas of the wafer.

In still another method of dividing the monitor areas into smaller areas, an entire surface of the wafer or each of the monitored areas Da to Dh may be divided into evenly sized areas (e.g., at 1 mm intervals), and each divided areas may be used as new monitored areas D1 to Dn (see FIG. 6D). The subscription "n" is the total number of divided monitored areas. When the monitored areas are divided into smaller areas in this manner, there may be no film thickness measurement points with the film thickness measuring device 8 within each monitored areas. Thus, the film thickness value at the representative point of each monitor area (e.g., a center position of each monitor area) can be calculated from the film thickness values measured at each measurement point by use of interpolation processing, so that representative film thickness values (estimated film thickness values) for each finely-divided monitor areas can be calculated. In this manner, the film thickness profile of wafer W can be more precisely controlled by dividing the monitored areas of wafer W into a greater number of areas than the total number of pressure chambers in the elastic membrane 5.

Figure 6E:
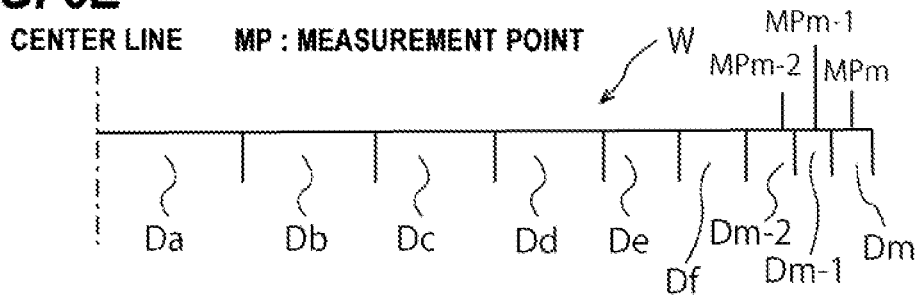
FIG. 6E is a schematic view showing an example of still another monitored areas of the wafer.

When determining the monitored areas of the film thickness in the wafer W, it is not necessary to select only one of the above described methods for setting the monitored areas, and a combination of several methods may be used. For example, in an inner area of wafer W (e.g., an area corresponding to the pressure chambers 7*a* to 7*f*), the monitored areas of the film thickness in the wafer W may be set to the monitor areas Da to Df corresponding to the pressure chambers 7*a* to 7*f*, and in an outer area of wafer W (e.g., an area corresponding to the pressure chambers 7*g* to 7*h*), the monitored areas of the film thickness in the wafer W may be set to the monitor areas corresponding to each measurement point MP of film thickness with the film thickness measuring device 8 (see FIGS. 6A and 6E).

Next, a method of creating the response model will be described. The response model is created, for example, by experiments. In the experiments, first, wafers whose film thickness profiles have already been acquired by the thickness measuring device 8 are polished using a reference polishing recipe (i.e., a predetermined polishing pressures and a predetermined polishing time), and the film thickness profiles of the wafers after polishing are obtained by the film thickness measuring device 8. Next, a number of wafers, which are different from the wafers W polished with the reference polishing recipe, are polished while changing the pressures of the pressurized fluid supplied to each of the pressure chambers 7*a* to 7*h* of the elastic membrane 5 and to the retainer chamber 34 from the pressures of the reference polishing recipe. In these procedures, film thickness profiles of a number of wafers before and after polishing are obtained by the film thickness measuring device 8.

Figure 7:
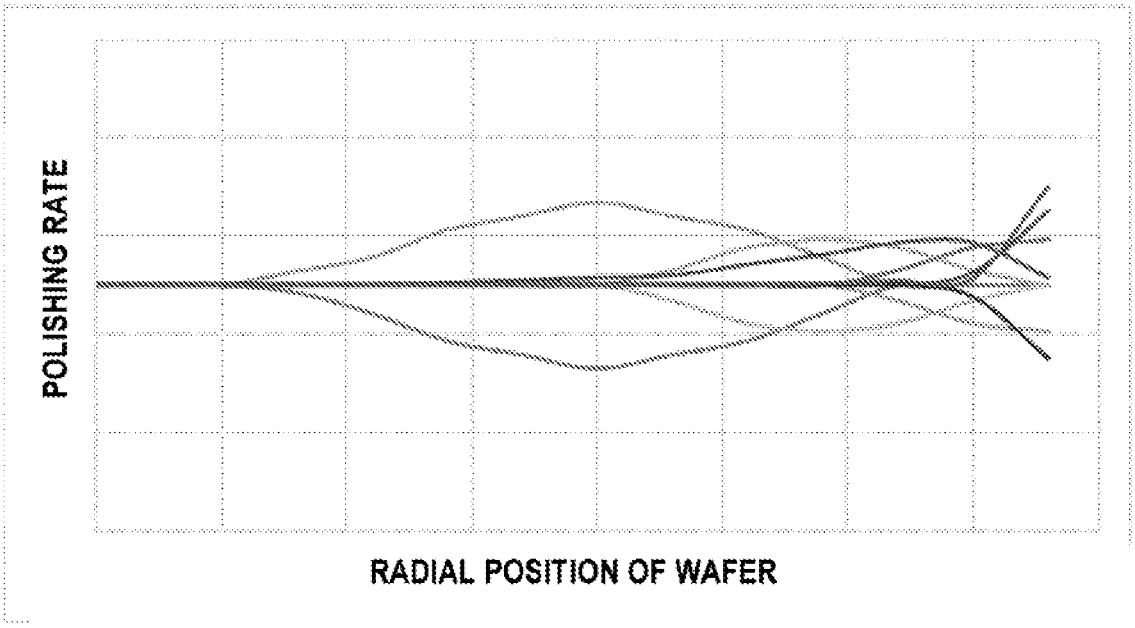
FIG. 7 is a conceptual view graphing polishing rates at each measurement point of a large number of wafers.

As described above, the film thickness measuring device 8 can measure the film thickness at the plurality of measurement points our the wafer W. Therefore, the controller 30 can calculate polishing rates at each measurement point from the film thickness profile of the wafer polished with the reference polishing recipe, and the film thickness profiles before and after polishing of a large number of wafers. FIG. 7 is a conceptual view graphing polishing rates at each measurement point of a large number of wafers. In FIG. 7, a vertical axis represents polishing rate and a horizontal axis represents radial position of the wafer.

Next, the controller 30 calculates an amount of increase in a polishing rate per unit polishing pressure (e.g., 1 hPa) from the polishing rates at each measurement point in a large number of wafers. In the present specification, the amount of increase in the polishing rate per unit polishing pressure is referred to as the "response coefficient". Further, an offset amount D is calculated such that the predicted polishing rate R, which is obtained by substituting the calculated response coefficient into an equation (3) described below, is equal to an actual polishing rate obtained by polishing of the wafer with the aforementioned reference polishing recipe.

Figure 8:
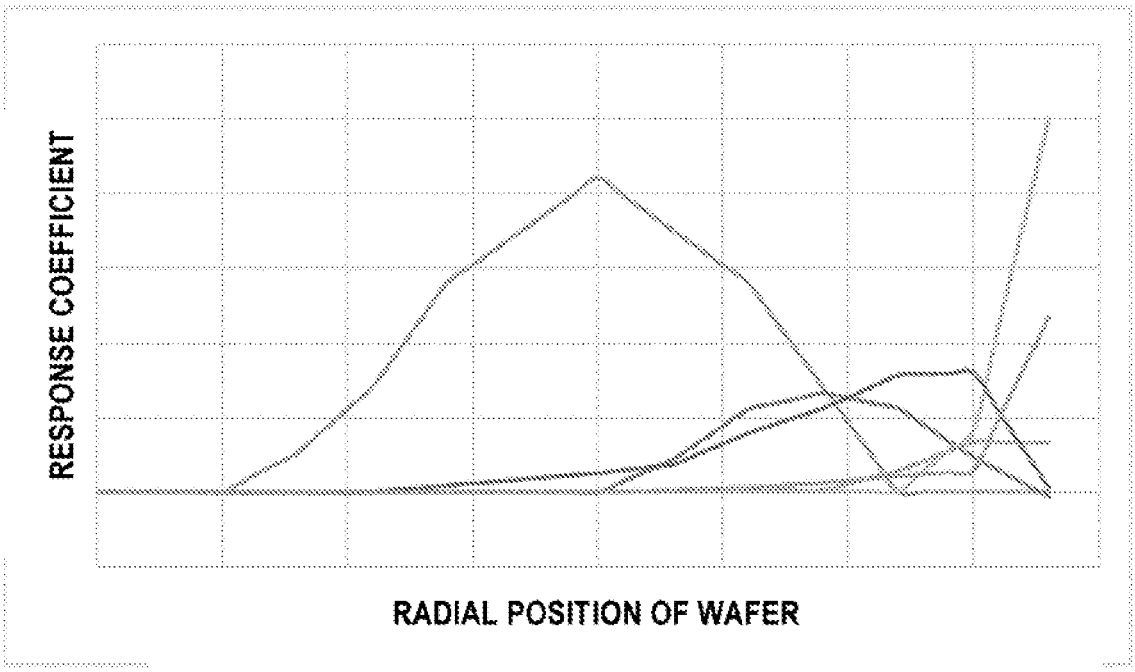
FIG. 8 is a conceptual view graphing the response coefficients at each measurement point of the wafer.

Further, from the calculated response coefficients and the offset amounts at each measurement point, response coefficients and offset amounts in each of the aforementioned monitored areas are calculated by an interpolation process, and thus the response coefficients and the offset amounts in each monitored area are determined. FIG. 8 is a conceptual view graphing the response coefficients at each measurement point of the wafer. In FIG. 8, a vertical axis represents the response coefficient, and a horizontal axis represents radial position of the wafer.

The response coefficients and offset amounts calculated in this manner are included in the response model. The controller 30 uses the response model to create an optimized polishing recipe. Specifically, the controller 30 uses a following equation (3) to calculate the predicted polishing amount R from the pressures of the pressurized fluid supplied to each of the pressure chambers 7*a* to 7*h* and the retainer chamber 34, and the polishing time.

$$R=Tp\cdot(C\cdot X+D) \tag{3}$$

Further, the calculated predicted polishing amount R is substituted into equation (1) or equation (2) to thereby calculate objective function value. The controller 30 uses optimization calculations to obtain the pressures of the pressurized fluid supplied to each of the pressure chambers 7*a* to 7*h* and the polishing time that minimize the objective function value, thereby creating the optimized polishing recipe. Since the aforementioned equation (1) or (2) can be expressed in the form of a quadratic equation in X, the optimized polishing recipe can be uniquely determined by using quadratic programming method in the optimization calculation. As other optimization calculation method, a gradient method, such as the steepest descent method, or the Monte Carlo method can also be used.

In equation (3), R is a matrix consisting of the predicted polishing amount R1 to Rm in each of the monitored areas D1 to Dm of the wafer W, Tp is the polishing time, C is a matrix consisting of the response coefficients in each of the monitored areas of wafer W, X is a matrix consisting of the pressures of the pressurized fluid supplied to each of the pressure chambers 7*a* to 7*h*, and D is a matrix consisting of the offsets of each of the monitored areas D1 to Dm in the wafer W. The subscript "m" corresponds to the number of monitored areas in the wafer W.

R, C, D, and X are represented as matrices as shown in FIG. 9. In the matrices R, C, and D, each row corresponds to each of the monitored areas D1 to Dm in the wafer W. The matrix X to be multiplied by the matrix C corresponds to the pressures of the pressurized fluid to be supplied to each of the pressure chambers 7*a* to 7*h* of the elastic membrane 5. Therefore, in the matrix X, "Pa" is the pressure of the pressurized fluid to be supplied to the pressure chamber 7*a* of the elastic membrane 5, and "Pc" is the pressure of the pressurized fluid to be supplied to the pressure chamber 7*c* of the elastic membrane 5.

The former of the two subscripts of the response coefficient in the matrix C corresponds to each of the monitored areas D1 to Dm in the wafer W, and the latter corresponds to the pressure of the pressurized fluid to be supplied to each of the pressure chambers 7*a* to 7*h*. For example, the response coefficient C2*b* is a response coefficient corresponding to the pressure of the pressurized fluid to be supplied to the pressure chamber 7*b* in the monitored area D2 of the wafer W, and the response coefficient C3*c* is a response coefficient corresponding to the pressure of the pressurized fluid to be supplied to the pressure chamber 7*c* in the monitored area D3 of the wafer W.

The controller 30 uses the optimization calculations described above to calculate the pressures Pa to Ph of the pressurized fluid to be supplied to each of the pressure chambers 7*a* to 7*h* of the elastic membrane 5 and the polishing time Tp, and thus uses these pressures Pa to Ph and the polishing time Tp as the optimized polishing recipe. In the optimized polishing recipe calculated in this manner, the polishing pressures of each of the pressure chambers 7*a* to 7*h* is determined utilizing the plurality of measured film thickness values in each of the monitored area D1 to Dm of the wafer W, and as a result, the film thickness profile of wafer W can be precisely controlled.

In one embodiment, an optimized polishing recipe, in which the pressure Pi of the pressurized fluid to be supplied to the retainer chamber 34 is added to the pressures Pa to Ph of the pressurized fluid to be supplied to each of the pressure chambers 7*a* to 7*h* in the elastic membrane 5 and the polishing time Tp, may be calculated. In this case, instead of the response matrix C described above, a matrix C as shown in FIG. 10 is used, which consists of the response coefficients C1*a* to Cmh corresponding to the pressures of the pressurized fluid to be supplied to each of the pressure chambers 7*a* to 7*h*, and response coefficients C1*i* to Cmi corresponding to the pressure of the pressurized fluid to be supplied to the retainer chamber 34. Further, instead of the matrix X, a matrix X' is used, which consists of the pressures Pa to Ph of the pressurized fluid to be supplied to each of the pressure chambers 7*a* to 7*h* in the elastic membrane 5, and the pressure Pi of the pressurized fluid supplied to the retainer chamber 34.

The response coefficients C1*a* to Cmh and the response coefficients C1*i* to Cmi can be determined as follows. First, in the experiments to determine the response coefficients C1*a* to Cmh, the pressures of the pressurized fluid supplied to each of the pressure chambers 7*a* to 7*h* is changed with the pressure of the pressurized fluid supplied to the retainer chamber 34 fixed to a predetermined value to calculate the response coefficients Ca1 to Cmh. Next, with the pressures of the pressurized fluid supplied to each of the pressure chambers 7*a* to 7*h* fixed at predetermined values, the pressure of the pressurized fluid supplied to the retainer chamber 34 is changed to obtain the response coefficients C1*i* to Cmi.

The optimized polishing recipe obtained using the matrix C' of the response model described above takes into consideration not only variation in the amount of polishing between the monitored areas D1 to Dm due to variations in the pressures of the pressurized fluid supplied to each of the pressure chambers 7*a* to 7*h*, but also variation in the amount of polishing between the monitored areas D1 to Dm due to variation in the pressing force of the retaining ring 3 on the polishing pad 33. Therefore, the film thickness profile of wafer W can be controlled more precisely.

In one embodiment, the response model, i.e., the matrix C consisting of the response coefficients C1*a* to Cmh (or the matrix C' consisting of C1*i* to Cmi) and the matrix D (or matrix D') may be determined by simulations. In this case also, the matrix C (or the matrix C') and the matrix D (or the matrix D') obtained by simulations are stored in the controller 30 in advance.

Returning to FIG. 5, the controller 30 causes the wafer W to be transferred to any one of the polishing units 14*a* to 14*d*, and to be polished with the optimized polishing recipe described above (see STEP 3 in FIG. 5). Polishing of the wafer W is performed as follows. As shown in FIG. 2, the polishing head 37 and the polishing table 35 are rotated in directions indicated by arrows, while the polishing liquid (or slurry) is supplied from the polishing-liquid supply nozzle 38 onto the polishing pad 33. In this state, the polishing head 37 presses the wafer W against the polishing surface 33*a*, of the polishing pad 33 for the polishing time according to the optimized polishing recipe. When pressing wafer W onto polishing pad 33, the pressures of the pressurized fluid supplied to each of the pressure chambers 7*a* to 7*h* and the retainer chamber 34 is regulated to the pressures according to the optimized polishing recipe. The surface of the wafer W is polished by a mechanical action of abrasive grains contained in the polishing liquid and a chemical action of the polishing liquid. After polishing of the wafer W, dressing (or conditioning) of the polishing surface 33*a* is performed by the dressing apparatus 40.

Dressing of the polishing pad 33 is performed as follows. The pure water is supplied from the polishing-liquid supplying nozzle 38 onto the polishing pad 33, while the dresser 41 is rotated about the dresser shaft 45. In this state, the dresser 41 is pressed against the polishing pad 33 by the pneumatic cylinder 47 to place the dressing surface 41*a* in sliding contact with the polishing surface 13*a* of the polishing pad 33. Further, the dresser arm 48 pivots around the dresser pivot shaft 49 to cause the dresser 41 to oscillate in a radial direction of the polishing pad 33. In this manner, the dresser 41 scrapes slightly the polishing pad 33 to thereby dress (or restore) the surface 33*a* of the polishing pad 33.

Next, the controller 30 causes the polished wafer W to be transferred to the first cleaning unit 16 and/or the second cleaning unit and to be cleaned, and then the cleaned wafer W to be transferred to the drying unit 20 to be dried. Further, the controller 30 causes the polished wafer W to be transferred to the film thickness measuring device 8 to obtain the film thickness profile of the polished wafer W (see STEP 4 in FIG. 5). The controller 30 stores therein the film thickness profiles of the wafer W before and after polishing, and the optimized polishing recipe that has polished this wafer W.

Next, the controller 30 corrects the stored response model in order to create an optimized polishing recipe for polishing the next wafer W (see STEP 5 in FIG. 5). Correction of the response model is performed as follows.

The controller 30 calculates an actual polishing amount Rac in each of the monitored areas D1 to Dm of the wafer W from the film thickness profiles before and after polishing of the wafer W which has already been polished. When calculating the actual polishing amount Rac, the controller 30 subtracts film thickness values after polishing T1' to Tm', which are representative values of a plurality of measured film thickness values corresponding to each of the monitored areas D1 to Dm of the wafer W after polishing, from the aforementioned initial film thickness values T1 to Tm in each of the monitored areas D1 to Dm, respectively. Each of the polishing film thickness values after polishing T1' to Tm' are, for example, an average value of the measured film thickness values in each of the monitored areas D1 to Dm, or each of thickness values at a representative point in each monitored area calculated by interpolation from the measured polishing film thickness values after polishing. The controller 30 subtracts the film thickness values after polishing T1' to Tm' from the initial film thicknesses T1 to Tm, respectively, thereby calculating the actual polishing amounts Rac1 to Racm in each of the monitored areas D1 to Dm.

Next, the controller 30 calculates a correction factor K such that the predicted polishing amount R in the above equation (3) and the actual polishing amount Rac satisfy the following equation (3).

$$Rac=K\cdot R \tag{4}$$

wherein Rac is a matrix consisting of the actual polishing amounts Rac1 to Racm in each of the monitored area D1 to Dm, and K is a matrix consisting of the correction factors corresponding to each of the monitored area D1 to Dm.

Next, as shown in following equations (5) and (6), the controller 30 calculates and stores a collected response coefficient matrix Cadj and a corrected offset amount matrix Dadj by multiplying the matrices C and D described above by K obtained from equation (4).

$$Cadj=K\cdot C \tag{5}$$

$$Dadj=K\cdot D \quad (6)$$

Next, the controller 30 causes the next wafer W to be transferred to the film thickness measuring device 8 and to obtain a film thickness profile of the next wafer W before polishing (see STEP 6 in FIG. 5).

Next, the controller 30 utilizes a corrected predicted polishing amount Radj, which is calculated from a following equation (7), to calculate the pressures of the pressurized fluid supplied to each of pressure chambers 7*a* to 7*h* and the retainer chamber 34, and the polishing time by use of the optimization calculations described above.

$$Radj=Tp\cdot(Cadj\cdot X+Dadj) \quad (7)$$

In the equation (7), Radj is a matrix consisting of the predicted polishing amount in each of the monitored areas D1 to Dm, and Tp is the polishing time of the next wafer W.

In this system, the response model corrected based on the film thickness profiles before and after polishing of the previous wafer W is used to create the optimized polishing recipe used for polishing the next wafer W. The film thickness profiles before and after polishing of the previous wafer W are data reflecting the condition (e.g., surface properties of the polishing pad 33) of the polishing unit where the wafer W was actually polished. Therefore, by using the response model corrected based on the film thickness profiles before and after polishing of the previous wafer W to create the optimized polishing recipe for polishing the next wafer W, the film thickness profile of the next wafer W can be controlled more precisely.

Next, the controller 30 causes the next wafer W to be polished with the created optimized polishing recipe (see STEP 8 in FIG. 5). Next, the controller 30 causes the polished next wafer W to be transferred to the first cleaning unit 16 and/or the second cleaning unit 18 and to be cleaned, and then the cleaned next wafer W to be transferred to the drying unit 20 and to be dried. Further, the controller 30 causes the polished next wafer W to be transferred to the film thickness measuring device 8 to obtain the film thickness profile of the polished wafer W (see STEP 9 in FIG. 5).

Further, the controller 30 repeats STEPS 5 to 9 shown in FIG. 5. Specifically, before polishing a further next wafer W, the controller 30 corrects the response model using the film thickness profiles before and after polishing, of the next wafer W and the optimized polishing recipe. Next, the film thickness profile of the further next wafer W before polishing is obtained by use of the film thickness measuring device 8. Next, based on the corrected response model, the optimized polishing recipe for polishing the further next wafer W is created. The controller 30 then causes the further next wafer W to be polished with the created optimized polishing recipe and obtains a film thickness profile of the further next wafer W after polishing. In this manner, the response model is corrected each time a wafer W is polished, so that the film thickness profile of the next wafer W can be controlled more precisely.

In one embodiment, the controller 30 may be connected to an arithmetic unit 70 (see dotted line in FIG. 1) provided outside the polishing apparatus, such that data can be sent and received. In this case, the response model is stored in advance in the arithmetic unit 70, and the controller 30 sends the film thickness profile before polishing and the target film thickness to the arithmetic unit 70. The arithmetic unit 70 creates an optimized polishing recipe based on the polishing amount, which is a difference between the sent film thickness profile and the target film thickness, and the response model. The arithmetic unit 70 then sends the optimized polishing recipe to the controller 30 of the polishing apparatus, and the controller 30 uses the received optimized polishing recipe to polish the wafer W. Further, the controller 30 sends the film thickness profile of the wafer W after polishing to the arithmetic unit 70, and the arithmetic unit 70 stores the film thickness profiles of wafer W before and after polishing and the optimized polishing recipe used for polishing this wafer W. Further, the controller 30 corrects the response model using film thickness profiles of wafer W before and after polishing and the optimized polishing recipe used to polish this wafer W.

When polishing a next wafer W, the controller 30 sends the film thickness profile of the next wafer W before polishing to the arithmetic unit 70. The arithmetic unit 70 creates an optimized polishing recipe for polishing the next wafer W based on a target polishing amount, which is the difference between the film thickness profile of the next wafer W before polishing and the target film thickness, and the corrected response model. The arithmetic unit 70 sends the created optical polishing recipe to the controller 30. The controller 30 uses the sent optimized polishing recipe to polish the next wafer W. Further, the controller 30 sends the film thickness profile of the next wafer W after polishing to the arithmetic unit 70, and the arithmetic unit 70 stores the film thickness profiles of the next wafer W before and after polishing, and the optimized polishing recipe used to polish the next wafer W. The arithmetic unit 70 utilizes the film thickness profiles of the next wafer W before and after polishing and the optimized polishing recipe used to polish the next wafer W for correcting the response model to be used to polish a further next wafer W.

Figure 11:
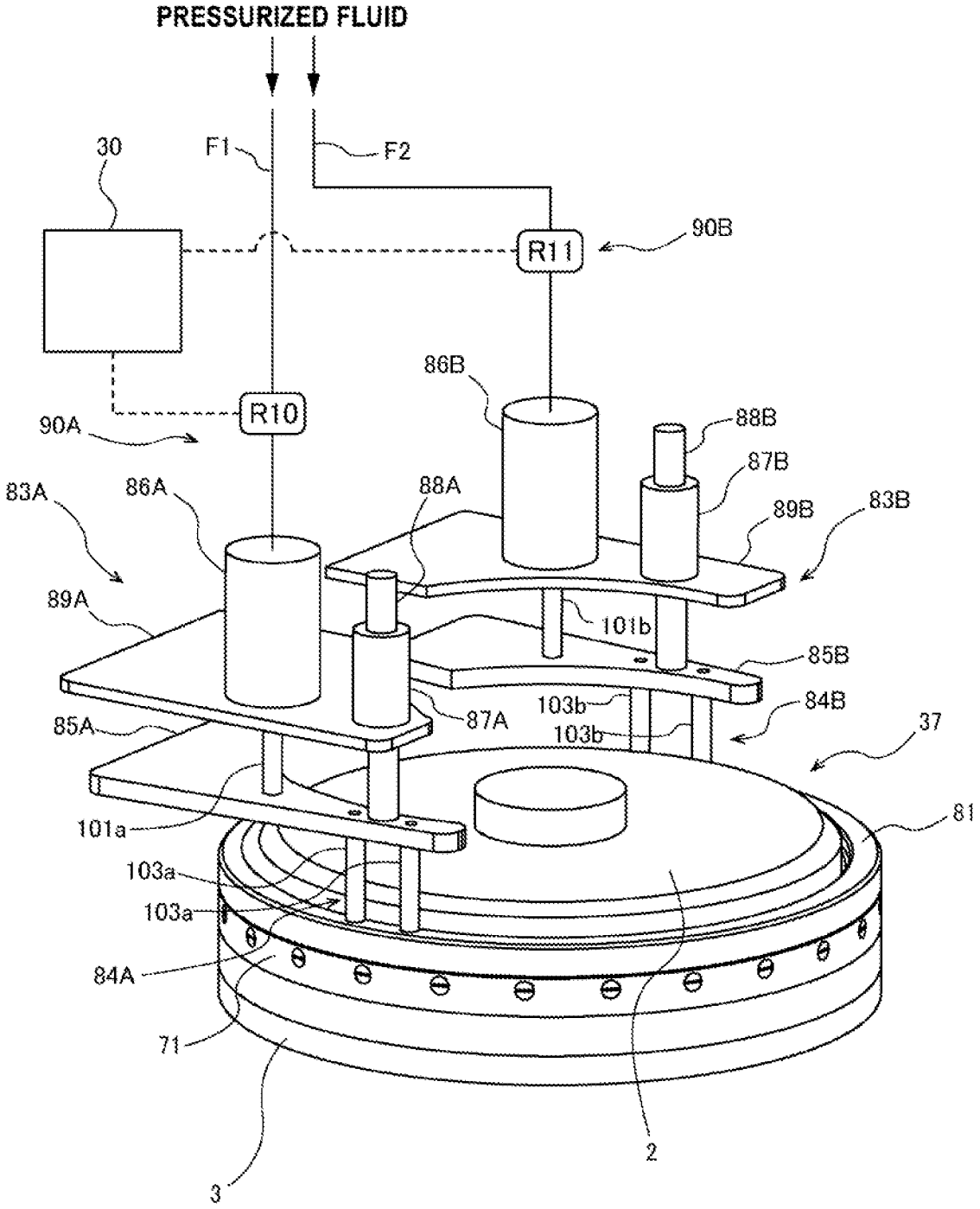
FIG. 11 is a perspective view schematically showing the polishing head according to another embodiment.

FIG. 11 is a perspective view schematically showing a polishing head according to another embodiment. Configurations of this embodiment, which will not be particularly described, are the same as those of the embodiments described above, and thus duplicate descriptions thereof will be omitted. Hereinafter, an example in which the polishing head 37 to be described with reference to FIG. 11 is mounted to the polishing unit 14*a* shown in FIG. 1 will be described. However, this polishing head 37 may be mounted to any of the polishing units 14*b* to 14*d*.

The polishing head 37 shown in FIG. 11 includes a head body 2 for pressing the wafer W against the polishing pad 33, and a retainer ring 3 arranged so as to surround the wafer W. The retainer ring 3 is configured to be movable in vertical directions independently of the head body 2. The retainer ring 3 projects radially outwardly from the head body 2. During polishing of the wafer W, the retainer ring 3 contacts the polishing surface 33*a* of the polishing pad 33, and presses the polishing pad 33 outside the wafer while the retainer ring 3 is rotating.

The polishing head 37 further includes a rotary ring 71 having a plurality of rollers disposed therein, and a stationary ring 81. The rotary ring 71 is fixed to an upper surface of the retainer ring 3, and is configured to be rotatable together with the retainer ring 3. The stationary ring 81 is located on the rotary ring 71. The rotary ring 71 rotates together with the retainer ring 3, while the stationary ring 81 does not rotate and remains stationary.

The polishing unit 14*a* includes a plurality of local-load exerting devices for applying a local load to a part of the retainer ring 3. In an example illustrated in the drawing, the polishing unit 14*a* includes two local-load exerting devices, i.e., a first local-load exerting device 83A and a second local-load exerting device 83B. The local-load exerting devices 83A, 83B are located above the retainer ring 3. The local-load exerting devices 83A, 83B are fixed to the head arm 42 (see FIG. 2). While the retainer ring 3 rotates about its central axis during polishing of the wafer, the local-load exerting devices 83A, 83B do not rotate together with the retainer ring 3 and remain stationary. The stationary ring 81 is coupled to the local-load exerting devices 83A, 83B. The first local-load exerting device 83A is arranged at an upstream side of the retainer ring 3 with respect to the moving direction of the polishing surface 33*a* of the polishing pad 33 (i.e., arranged at one side of the retainer ring 3 into which the polishing surface 33*a* moves). The second local-load exerting device 83B is arranged at a downstream side of the retainer ring 3 with respect to the moving direction of the polishing surface 33*a* of the polishing pad 33 (i.e., arranged at the opposite side of the retainer ring 3 from which the polishing surface 33*a* moves out).

The local-load exerting devices 83A, 83B include pressing members 84A, 84B each for applying a downward local load to the stationary ring 81, bridges 85A, 85B, air cylinders 86A, 86B each for generating a downward force, pressure regulators R10, R11 for regulating pressures of compressed fluids in the air cylinders 86A, 86B, linear guides 87A, 87B, guide roofs 88A, 88B, and unit bases 89A, 89B.

Specifically, the first local-load exerting device 83A includes the first pressing member 84A the first bridge 85A, the first air cylinder 86A, the first pressure regulator R10, the first linear guide 87A, the first guide rod 88A, and the first unit base 89A. The second local-load exerting device 83B includes the second pressing member 84B, the second bridge 85B, the second air cylinder 86B, the second pressure regulator R11, the second linear guide 87B, the second guide rod 88B, and the second unit base 89B.

A piston rod 101*a* of the first air cylinder 86A is coupled to the first pressing member 84A through the first bridge 85A, and an end portion of the first pressing member 84A is coupled to the stationary ring 81. Therefore, the force generated by the first air cylinder 86A is transmitted to the first pressing member 84A, and the first pressing member 84A applies the local load to a part of the stationary ring 81. Similarly, a piston rod 101*b* of the second air cylinder 86B is coupled to the second pressing member 84B through the second bridge 85B, and an end portion of the second pressing member 84B is coupled to the stationary ring 81. Therefore, the force generated by the second air cylinder 86B is transmitted to the second pressing member 84B, and the second pressing member 84B applies the local load to a part of the stationary ring 81.

In this embodiment, a combination of the tint air cylinder 86A and the first pressure regulator R10 constitutes a first actuator 90A for regulating the local load applied from the first pressing member 84A to the stationary ring 81, and a combination of the second air cylinder 86B and the second pressure regulator R11 constitutes a second actuator 90B for regulating the local load applied from the second pressing member 84B to the stationary ring 81. In one embodiment, the first actuator 37A and the second actuator 37B may be each composed of a combination of a servomotor, a ball screw mechanism, and a motor driver.

The first pressing member 84A includes two push rods 103*a*, and the second pressing member 84B includes two push rods 103*b*. The push rods 103*a* and the push rods 103*b* are coupled to the stationary ring 81. The first pressing member 84A is configured to apply the local load to the upstream portion of the stationary ring 81 with respect to the moving direction of the polishing surface 33*a* of the polishing pad 33, and the second pressing member 84B is configured to apply the local load to the downstream portion of the stationary ring 81 with respect to the moving direction of the polishing surface 33*a* of the polishing pad 33.

The local-load exerting devices 83A, 83B are fixed to the head arm 42 (see FIG. 2) through the unit bases 89A, 89B, respectively. Therefore, during polishing of the wafer the polishing head 37 and the war W are rotating, while the local-load exerting devices 83A, 83B remain stationary. Similarly, during polishing of the wafer W, the rotary ring 71 is rotating together with the polishing head 37, while the stationary ring 81 remains stationary.

The local-load exerting devices 83A, 83B have the same construction. The following descriptions relate to the first local-load exerting device 83A, but are applied to the second local-load exerting device 83B as well. The first air cylinder 86A and the first linear guide 87A are mounted to the first unit base 89A. The piston rod 101*a* of the first air cylinder 86A and the first guide rod 88A are coupled to the first bridge 85A. The first guide rod 88A is vertically movably supported by the first linear guide 87A with low friction. The first linear guide 87A allows the first bridge 85A to move smoothly in the vertical directions without being inclined.

The air cylinders 86A, 86B are coupled to a compressed-gas supply source (see FIG. 4) through gas delivery lines F1, F2. The pressure regulators R10, R11 are attached to the gas delivery lines F1, F2, respectively, and are disposed in the pressure regulating device 65 shown in FIG. 4. Compressed gases from the compressed-gas supply source are supplied through the pressure regulators R10, R11 into the air cylinders 86A, 86B, respectively and independently.

The pressure regulators R10, R11 can regulate independently the pressures of the compressed gases in the air cylinders 86A, 86B, so that the air cylinders 86A, 86B can generate the forces independently of each other.

The pressure regulators R10, R11 are electrically connected to the controller 30 shown in FIG. 1. During polishing of the wafer W, the controller 30 instructs one of the pressure regulators R10, R11 to regulate the pressure of the compressed gas in the air cylinder 86A or the air cylinder 86B.

The forces generated by the air cylinders 86A, 86B are transmitted to the bridges 85A, 85B, respectively. The bridges 85A, 85B are coupled to the stationary ring 81 through the pressing members 84A, 84B. The pressing members 84A, 84B transmit the forces of the air cylinders 86A, 86, applied to the bridges 85A, 85B, to the stationary ring 81. Specifically, the first pressing member 84A presses a part of the stationary ring 81 with a local load corresponding to the force generated by the fast air cylinder 86A, and the second pressing member 84B presses a part of the stationary ring 81 with a local load corresponding to the fore generated by the second air cylinder 86B.

Each of the local-load exerting devices 83A, 83B is configured to exert the downward local load on a part of the retainer ring 3 through the stationary ring 81 and the rotary ring 71. Specifically, the downward local load is transmitted through the stationary ring 81 and the rotary ring 71 to the retainer ring 3.

The polishing apparatus polishes the wafer W while rotating the rotary ring 71, which is fixed to the retainer ring 3, together with the retainer ring 3 and applying the local load to the stationary ring 81 from the first pressing member 84A or the second pressing member 84B. During polishing of the wafer W, the rotating retainer ring 3 contacts the polishing surface 33*a* of the polishing pad 33, while pressing the polishing pad 33 outside the wafer W and applying the downward local load on a part of the polishing surface 33*a*.

Figure 12:
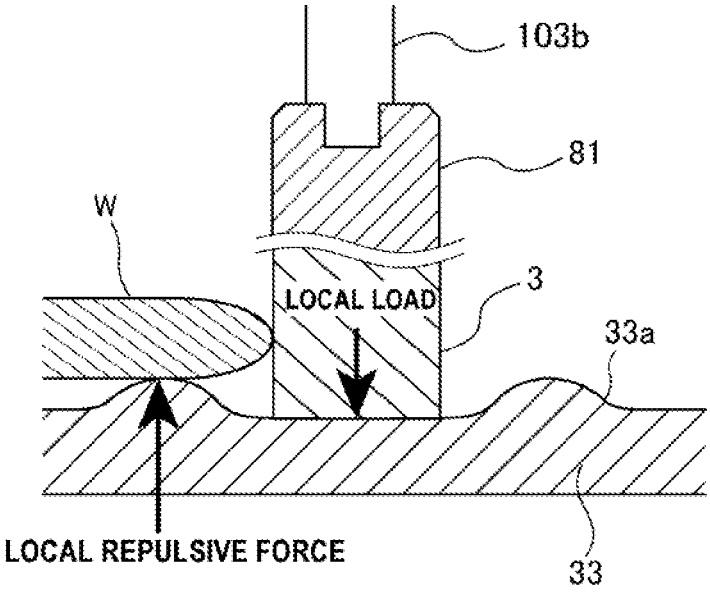
FIG. 12 is a vertical cross-sectional view schematically showing a state where a retainer ring is pressing a polishing surface.

FIG. 12 is a vertical cross-sectional view schematically showing a state where the retainer ring is pressing the polishing surface. As shown in FIG. 12, when the retainer ring 3 applies the downward local load to a part of the polishing surface 33*a*, a part of the polishing surface 33*a* rises upward. The upwardly-raised polishing surface 33*a* applies in turn an upward local load to the wafer W. In this specification, this upward local load is referred to as a local repulsive force. In FIG. 12, for illustration purposes, only the raised portion of the polishing surface 33*a* contacts the wafer W. However during polishing, the entire lower surface of the wafer W (i.e., the surface to be polished) is actually in contact with the polishing surface 33*a*. A polishing rate of wafer W in an area applying the local repulsive force is applied becomes larger. A magnitude of the local repulsive force depends on a magnitude of the force with which the retainer ring 3 presses the polishing pad 33. The polishing rate changes in accordance with the magnitude of the local repulsive force. Specifically, the greater the local repulsive force, the higher the polishing rate. A position at which the local repulsive force is generated depends on a position of the local load exerted by the retaining ring 3 on the polishing surface 33*a*.

Therefore, the wafer W is polished, while the local load is applied from either the first pressing member 84A or the second pressing member 84B to the stationary ring 81, to thereby generate the local repulsive force corresponding to the local load, so that a polishing rate of a portion of the wafer receiving the local repulsive force can be changed. For example, when the local load applied by the first pressing member 84A is to be increased, the controller 30 instructs the pressure regulator R10 to increase the pressure of the compressed gas in the air cylinder 86A, while, when the local load applied by the second pressing member 84B is to be increased, instructing the pressure regulator R11 to increase the pressure of the compressed gas in the air cylinder 86B.

Accordingly, the local loads applied to the retaining ring 3 by the local-load exerting devices 83A, 83B (in this embodiment, corresponding to the pressures of the compressed gas supplied to the air cylinders 86A, 86B) become also factors that affects the film thickness profile of the wafer W after polishing.

Therefore, in this embodiment, the controller 30 (see FIG. 1) calculates the response model described above (i.e., the matrix C consisting of the response coefficients C1*a* to Cmh mentioned above and the matrix D consisting of the offset values) with consideration of the local load in addition to the pressures of the pressurized fluid supplied to each of the pressure chambers 7*a* to 7*h* and to the retainer chamber 34. Further, the controller 30 uses the response model, which also takes into account the local load, to create the optimized polishing recipe (see STEP 3 in FIG. 5).

The optimized polishing recipe obtained in this manner takes into consideration variation in the amount of polishing between the monitored areas D1 to Dm due to variation in the pressure of the pressurized fluid supplied to each of the pressure chambers 7*a* to 7*h*, variation in the amount of polishing between the monitored areas D1 to Dm due to variation in the pressing force of the retainer ring 3 on the polishing pad 33, and variation in the amount of polishing between the monitored areas D1 to Dm due to variation in the local load. Therefore, the film thickness profile of wafer W can be controlled more precisely.

Further, in the corrected response model also, used to calculate the optimized polishing recipe for polishing the next wafer W, the variation in the amount of polishing between the monitored areas D1 to Dm due to the variation in the pressure of the pressurized fluid supplied to each of the pressure chambers 7*a* to 7*h*, the variation in the amount of polishing between the monitored areas D1 to Dm due to the variation in the pressing force of the retainer ring 3 on the polishing pad 33, and the variation in the amount of polishing between the monitored areas D1 to Dm due to the variation in the local load are taken into account. Therefore, the film thickness profile of the next wafer W to be polished with the optimized polishing recipe created based on the corrected response model can also be controlled more precisely.

Figure 13:
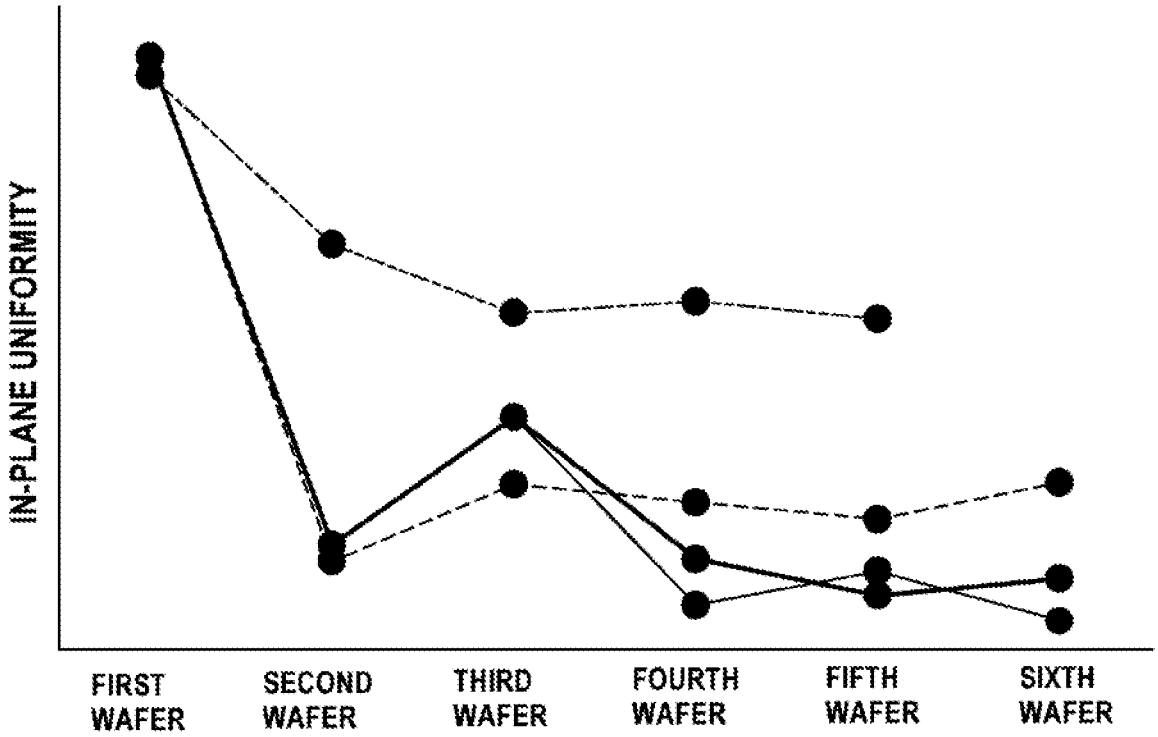
FIG. 13 is a graph showing changes in in-plane uniformity for each embodiment when a plurality of wafers are polished in series using methods of creating the optimized polishing recipes according to a plurality of embodiments.

FIG. 13 is a graph showing changes in in-plane uniformity for each embodiment when a plurality of wafers are polished in series using the optimized polishing recipes according to the plurality of embodiments. In FIG. 13, a vertical axis represents the in-plane uniformity, and a horizontal axis represents the order of wafers polished sequentially. The in-plane uniformity shown in FIG. 13 is represented by a difference between the maximum and minimum measured film thickness values of the wafer W after polishing.

In FIG. 13, a dotted line shows a change in in-plane uniformity when the optimized polishing recipe is created and the response model is corrected using a response model created by taking into consideration only the variations in the pressures of the pressurized fluid supplied to each of the pressure chambers 7*a* to 7*h* (hereinafter referred to as "Case 1"). The thick solid line shows a change in in-plane uniformity when the optimized polishing recipe is created and the response model is corrected using a response model created by taking into consideration the variations in the pressures of the pressurized fluid supplied to each of the pressure chambers 7*a* to 7*h*, and the variations in the pressure of the pressurized fluid supplied to the retainer chamber 34 (hereinafter referred to as "Case 2"). The thin solid line shows a change in in-plane uniformity when the optimised polishing recipe is created and the response model is corrected using a response model created by taking into consideration the variations in the pressures of the pressurized fluid supplied to each of the pressure chambers 7*a* to 7*h*, the variations in the pressure of the pressurized fluid supplied to the retainer chamber 34, and the variations in the local load (hereinafter referred to as "Case 3").

The double-dotted graph in FIG. 13 shows a reference example, and a graph showing a change in in-plane uniformity when a plurality of wafers W are polished sequentially using a conventional method of regulating the polishing pressure. The conventional method of regulating the polishing pressure calculates differences between film thicknesses of the polished wafer W in each of the monitored areas Da to Dh corresponding to each pressure chambers 7*a* to 7*h*, and the target film thicknesses, respectively, and changes the pressures of the pressurized fluid supplied to each of the pressure chambers 7*a* to 7*h* such that the differences in each of the monitored areas Da to Dh are zero, thereby polishing the wafer W. In the conventional method of regulating the polishing pressure, the response model described above which takes into account changes in the amount of polishing between each of the monitored areas Da to Dh is not created, and the pressures of the pressurized fluid supplied to each of the pressure chambers 7*a* to 7*h* corresponds one-to-one with the amounts of polishing in each of the monitored areas Da to Dh7. Thus, the next wafer W is polished with the polishing recipe which does not take into account the variations in the amounts of polishing between each of the monitored areas Da to Dh due to the variations in the pressures of the pressurized fluid supplied to each of the pressure chambers 7*a* to 7*h*.

As can be seen from FIG. 13, the in-plane uniformities of Cases 1 to 3 are significantly improved than the in-plane uniformity of the reference case. Therefore, it can be seen that the film thickness profile can be precisely controlled by using the response model described above to perform sequential polishing of wafer W while creating the optimized polishing recipe and correcting the response model.

Further, it has been found that the in-plane uniformities of Cases 2 and 3 are better than the in-plane uniformity of Case 1. Therefore, it can be seen that, by using the response model which is created taking into account at least the changes in the pressures of the pressurized fluid supplied to each of the pressure chambers 7*a* to 7*h* and the change in the pressure of the pressurized fluid supplied to the retainer chamber 34, the film thickness profile can be controlled precisely.

Figure 14:
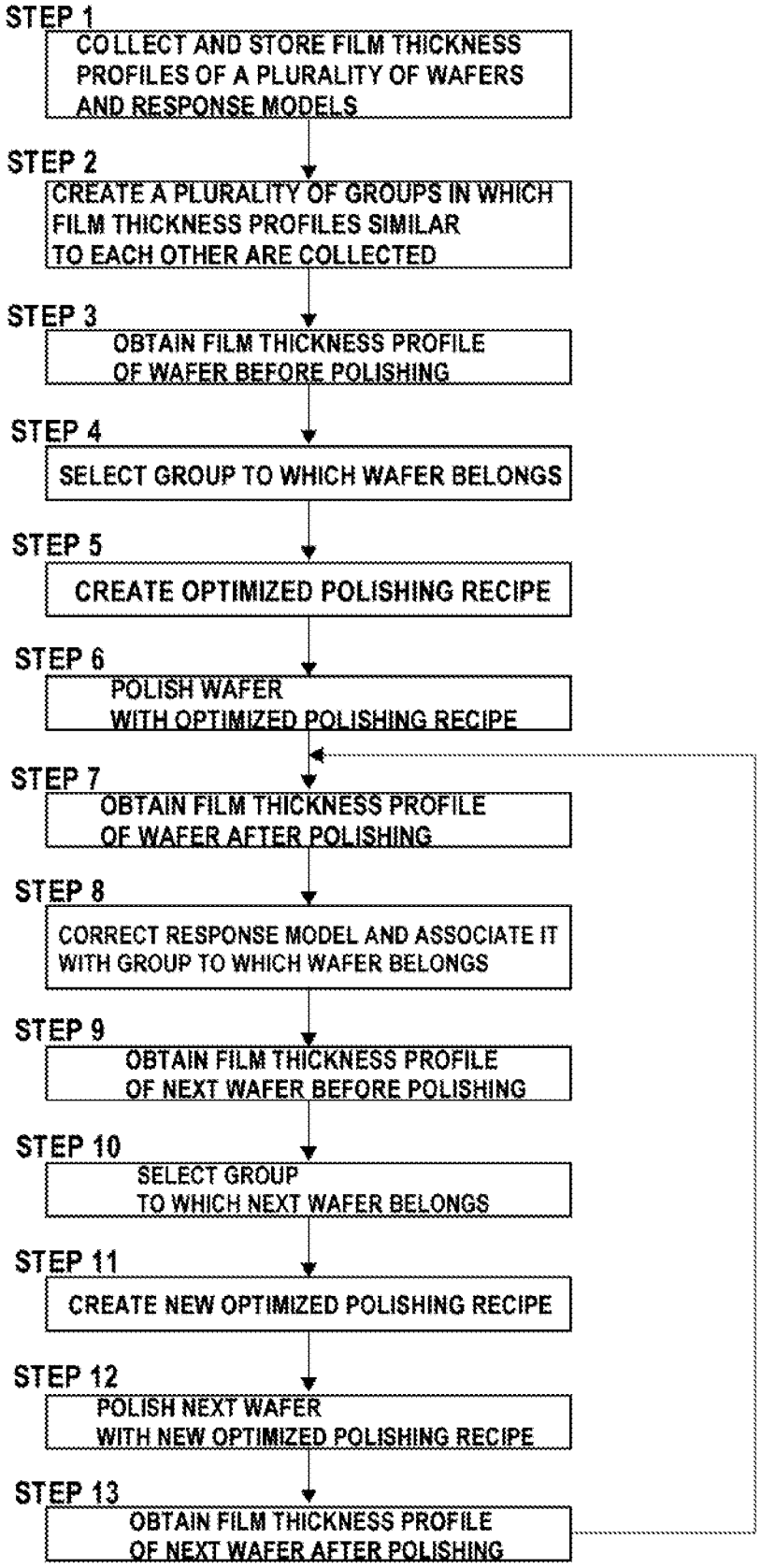
FIG. 14 is a flowchart showing a polishing method according to another embodiment.

FIG. 14 is a flowchart showing a polishing method according to another embodiment. STEPS of this embodiment, which will not be particularly described, are the same as the STEPS of the flowchart shown in FIG. 5, and thus duplicate descriptions thereof will be omitted. The polishing method shown in FIG. 14 may require a large amount of data processing, and thus is preferably performed in the polishing apparatus having the controller 30 which is connected to the arithmetic unit 70. Accordingly, in the followings, the method of polishing wafers W using the arithmetic unit 70 and the controller 30 will be described. However, if the controller 30 has sufficient data processing capability, the method shown in FIG. 14 may be performed only by the controller 30 without involving the arithmetic unit 70. In this case, "arithmetic unit 70" in the following description can be read as "controller 30" as appropriate.

As shown in FIG. 14, in this embodiment, the film thickness profiles of a plurality of wafers W before polishing and the response models are first collected and stored in a storage (not shown) provided in the arithmetic unit 70 (see STEP 1 in FIG. 14). Further, the arithmetic unit 70 classifies the plurality of film thickness profiles before polishing into a plurality of groups to which the film thickness profiles that are similar to each other belong (see STEP 2 in FIG. 14). The film thickness profile before polishing, of wafer W and the response model are associated with the group to which the wafer W belongs.

Each time polishing of the wafer W is performed, the controller 30 sends the film thickness profiles of the wafer W before and after polishing and the optimized polishing recipe used for polishing this wafer W to the arithmetic unit 70. Each time a combination of the film thickness profiles of the wafer W before and after polishing and the optimized polishing recipe are sent from the controller 30, the arithmetic unit 70 corrects the response model using the film thickness profiles of the wafer W before and after polishing and the optimized polishing recipe. Further, the arithmetic unit 70 classifies and accumulates a combination of the film thickness profiles of wafer W before and after polishing and the corrected response model into any one of the plurality of groups.

For classification by use of the film thickness before polishing, an index of conformity with shape, for example, can be used, which is obtained by calculations. Examples of the index of conformity with shape include absolute mean, root mean square, difference in average film thicknesses, correlation coefficient, and GOF (Good of Fitting) value. The index of conformity with shape is an index for determining a shape agreement (similarity) between two film thickness profiles, and can be calculated by any one of the following equations (8) to (11), where the first film thickness profiles are T1 to Tm, the average value of T1 to Tm is Tave, the second film thickness profiles are T'1 to T'm and the average value of T'1 to T'm is T'ave.

$$\text{Absolute mean} = \sum_{k=1}^{m} |T_k - T'_k|/m \tag{8}$$

$$\text{Root mean square} = \sum_{k=1}^{m} |Tk - T'k|^2 / m \tag{9}$$

$$\text{Difference of in average film thicknesses} = |Tave - T'avel \tag{10}$$

$$\text{Correlation coefficient} = \frac{\sum_{k=1}^{m}(Tk - Tave)(T'k - T'ave)}{\sqrt{\sum_{k=1}^{m}(Tk - Tave)^2}\sqrt{\sum_{k=1}^{m}(T'k - T'ave)^2}} \tag{11}$$

GOF is a commonly used index of agreement between two profiles. The smaller the value of absolute mean, root mean square, and difference in average film thicknesses, the higher the shape agreement (shape similarity), while the larger the value of correlation coefficient and GOF, the higher the shape agreement.

The arithmetic unit 70 classifies the film thickness profile by use of at least one of these indices of conformity with shape. Specifically, the arithmetic unit 70 calculates advance the film thickness profiles representing each group, calculates the index of conformity with shape between the film thickness profile before polishing and the film thickness profile representing each group, and classifies the film thickness profile before polishing into a group which has a shape agreement exceeding a preset threshold value, and has the highest shape agreement. The film thickness profiles representing each group can be, for example, average film thickness profiles averaged from the film thickness values at each measurement point of the film thickness profiles classified into each group.

When no group has the shape agreement exceeding the threshold value, i.e., when no group is to be classified based on the index of conformity with shape, the arithmetic unit 70 creates a new group. This process creates a plurality of groups in which film thickness profiles similar to each other are collected.

In one embodiment, a machine learner (not shown) may be provided in the arithmetic unit 70, and the machine learner may be used to classify the film thickness profile of the wafer W before polishing. In this case, the film thickness profile of the wafer W before polishing is input to the machine learner. The machine learner outputs the group to which the input film thickness profile belongs. When the machine learner deter lines that there is no group to which the input film thickness profile belongs, the machine learner outputs an instruction for creating a new group to the arithmetic unit 70.

Next, the controller 30 causes the wafer W to be taken out from the substrate cassette placed on the load port 12 (see FIG. 1) to be transferred to the film thickness measuring device 8, and obtains the film thickness profile of the wafer W before polishing (see STEP 3 in FIG. 14). This STEP 3 corresponds to STEP 1 in FIG. 5. Next, the controller 30 sends the film thickness profile of the wafer W before polishing to the arithmetic unit 70, and the arithmetic unit 70 selects the group to which the received film thickness profile (i.e., the wafer to be polished) belongs (see STEP 4 in FIG. 14).

When selecting the group, the arithmetic unit 70 uses the index of conformity with shape described above. Specifically, the arithmetic unit 70 calculates the index of conformity with shape for each group using the received film thickness profiles and the representative film thickness profile of each group, and selects the group which has the shape agreement exceeding the threshold value, and has the highest shape agreement as the group to which the film thickness profile is to belong.

Next, the arithmetic unit 70 creates the optimized polishing recipe using the response model of the group to which the film thickness profile belongs (see STEP 5 in FIG. 14). This STEP 5 corresponds to STEP 2 in FIG. 5, and thus description of the method of creating the optimized polishing recipe is omitted.

When, in STEP 4, no group has the shape agreement exceeding the threshold value, the arithmetic unit 70 selects the group which has the threshold value whose index of conformity with shape is highest, and utilizes the response model of this group to create the optimized polishing recipe. Further, the arithmetic unit 70 creates a new group to which this film thickness profile belongs.

Next, the arithmetic unit 70 sends the created optimized polishing recipe to the controller 30, and the controller 30 performs polishing of the wafer W based on the receiving polishing recipe (see STEP 6 in FIG. 14).

Next, the controller 30 causes the polished wafer W to be transferred to the first cleaning unit 16 and/or the second cleaning unit 18 and to be cleaned, and then the cleaned wafer W to be transferred to the drying unit 20 and to be dried. Further, the controller 30 causes the polished wafer W to be transferred to the film thickness measuring device 8 to obtain the film thickness profile of the polished wafer W (see STEP 7 in FIG. 14). The controller 30 corrects the response model by use of the film thickness profiles of the wafer W before and after polishing and the optimized polishing recipe, and further stores it in association with the group to which the film thickness profiles belongs (see STEP 8 in FIG. 12).

Processes described in STEPS 9 to 12 in FIG. 12 is the same as those described in the STEPS 6 to 9 in FIG. 5, and thus duplicate descriptions thereof will be omitted.

According to this embodiment, the optimized polishing model for the first wafer is created using the optimized polishing recipe and the response model that belong to the group having a similar film thickness profile to that of the first wafer W. Therefore, the film thickness profile of the first wafer W can be precisely controlled.

Figure 15:
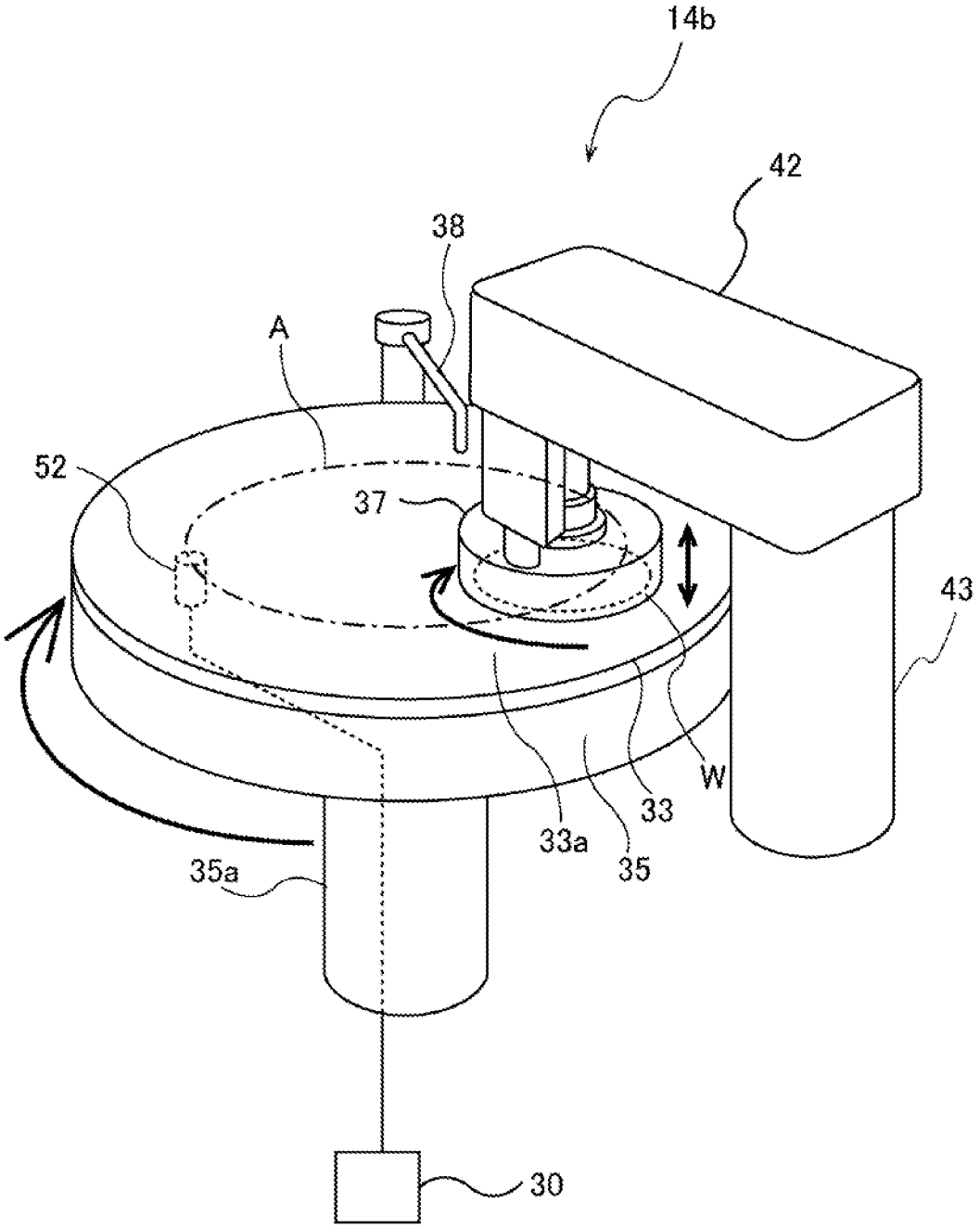
FIG. 15 is a schematic view showing the polishing unit according to another embodiment.

FIG. 15 is a schematic view showing the polishing unit according to another embodiment. Configurations of this embodiment, which will not be particularly described, are the same as those of the embodiments with reference to FIG. 2, and thus duplicate descriptions thereof will be omitted. In FIG. 15, the dressing unit 40 (see FIG. 2 is omitted from illustration. In the following, an example will be described, in which the polishing unit 14*b* shown in FIG. 1 is the polishing unit described with reference to FIG. 13. However, the polishing unit shown in FIG. 15 may be disposed as at least any one of the polishing unit 14*a*, 14*b*, and 14*c*.

Configuration of the polishing unit 14*b* shown in FIG. 15 is different from that of the polishing unit 14*a*, shown in FIG. 2 in that a film thickness sensor 52 for obtaining a film thickness signal which varies according to the film thickness of the wafer W is provided. The film thickness sensor 52 is arranged in the polishing table 35. Each time the polishing table 35 makes one rotation, the film thickness sensor 52 obtains the film thickness signals at a plurality of measurement points in each of the monitored areas D1 to Dm of the wafer W. Examples if the film thickness sensor 52 include an optical sensor, and an eddy current sensor.

During polishing of the wafer W, the film thickness sensor 52 rotates together with the polishing table 35, and obtains the film-thickness signal while sweeping across the surface of the wafer W as shown in symbol A. This film thickness signal comprises an index value that directly or indirectly indicates the film thickness of the wafer W. The film thickness signal varies as the film thickness of the wafer W decreases. The film thickness sensor 52 is coupled to the controller 30, so that the film thickness signal is sent to the controller 30. When the film thickness of the wafer W, indicated by the film-thickness signal, reaches a predetermined target thickness, the operation controller 40 instructs the polishing head 1 and the polishing table 2 to terminate polishing of the wafer W. The controller 30 can obtain the film thickness profile of wafer W from the film thickness signals sent from the film thickness sensor 52.

As semiconductor devices become more highly integrated and densified, wiring composed of a multilayer structure is formed on the wafer W. Therefore, if polishing of the wafer W is executed with one polishing unit until the desired film is exposed, the polishing time becomes longer, resulting in wafer defects due to the rise in polishing temperature and deposition of by-products on the polishing pad, or reducing in a flatness of the surface of the wafer. Depending on a film type of the multilayer structure formed in the wafer W, several polishing processes may be performed over two or more polishing units. For example, polishing a metal film, which is a top layer of wafer W, with the first polishing unit, and then a dielectric film layer formed under the metal film may be polished with the second polishing unit.

If, in a case where several polishing processes are performed sequentially in this manner, the film thickness profile after polishing is obtained with the film thickness measuring device 8 as shown in FIG. 2, each time one polishing process is completed, the throughput is decreased. Accordingly, in this embodiment, the film thickness sensor 52 is used to obtain the film thickness profile(s) of the water W before polishing and/or after polishing.

Figure 16:
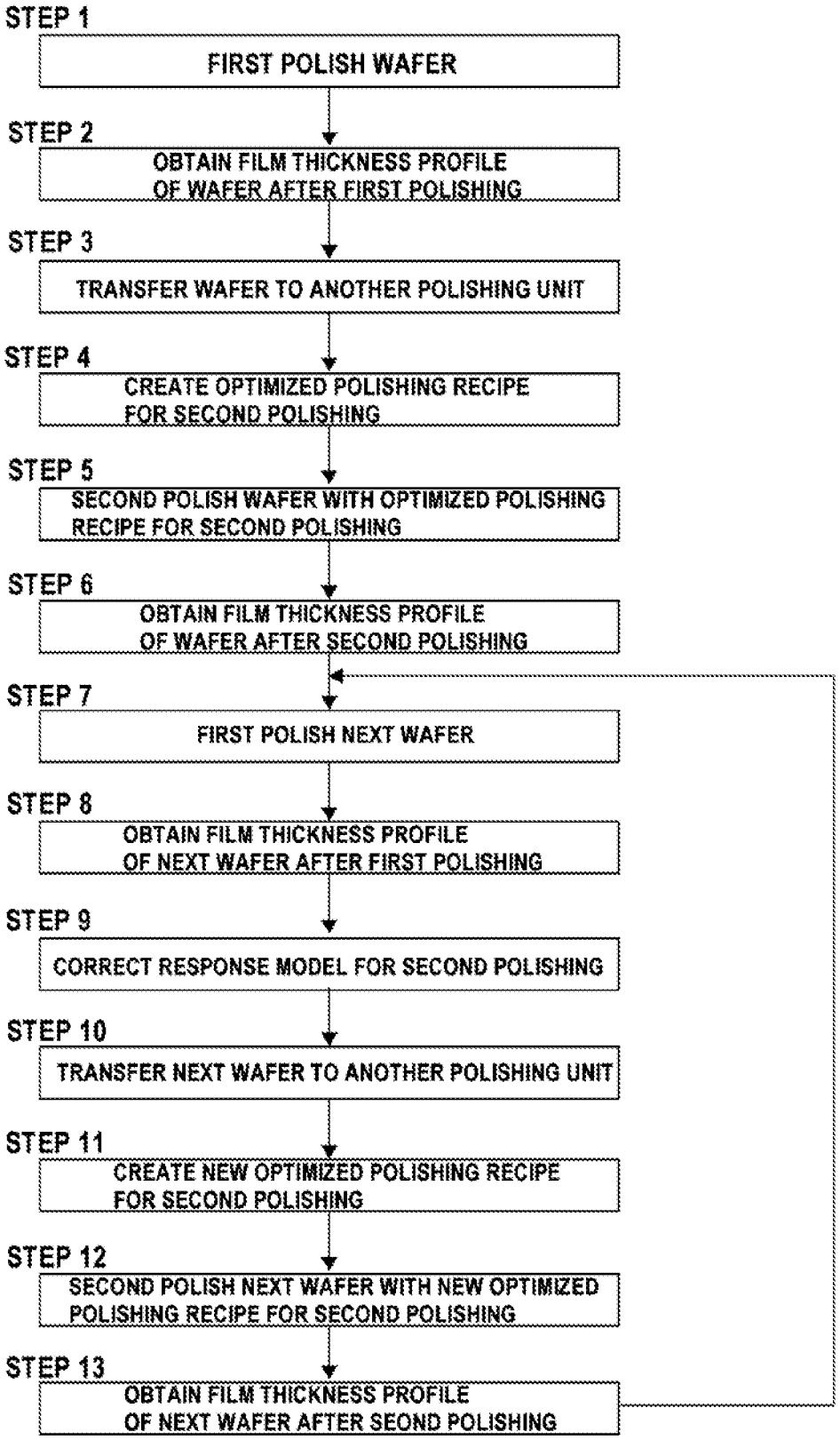
FIG. 16 is a flowchart showing a polishing method according to still another embodiment.

FIG. 16 is a flowchart showing a polishing method according to still other embodiments. STEPS of this embodiment, which will not be particularly described, are same as the STEPS of the flowchart shown in FIG. 5, and thus duplicated descriptions thereof will be omitted.

As shown in FIG. 16, the controller 30 first causes the wafer W to be taken out from the substrate cassette placed on the load port 12 (see FIG. 1) to be transferred to the first polishing unit having the film thickness sensor 52 (e.g., polishing unit 14*b*), and to polish the wafer W in the first polishing unit in accordance with a predetermined polishing recipe (STEP 1 in FIG. 16). During first polishing of wafer W, the controller 30 monitors the film thickness of the wafer W obtained from the measured values of the film thickness sensor 52, and terminates the first polishing when the film thickness reaches a predetermined threshold value (i.e., when the film thickness of the top layer in the wafer W reaches a predetermined target value).

When the first polishing of the wafer W is terminated, the controller 30 causes a water-polish, which polishes the wafer W while supplying pure water onto the polishing pad 33 on the polishing table 35, to be performed, and obtains, during this water-polishing, the thickness profile of the first polished wafer W by use of the film thickness sensor 52 (see STEP 2 in FIG. 16). During the water-polishing, polishing of wafer W does not substantially progress. Since water-polishing enables polishing liquid, polishing debris, by-products, etc. on the polishing pad 33 to be removed, a precise film thickness profile can be obtained even after the first polishing of the wafer W. The film thickness sensor 52 serves as a film thickness measuring device for obtaining the film thickness profile before a second polishing of the wafer W, which is required to create an optimized polishing recipe for the second polishing of wafer W.

Next, the controller 30 causes the first polished wafer W to be transferred to the second polishing unit (e.g., polishing unit 14*a*), which is other than the first polishing unit, for performing the second polishing (STEP 3 in FIG. 16). At this time, the controller 30 creates an optimized polishing recipe for the second polishing of the wafer W based on the film thickness profile of the wafer W before the second polishing (i.e., the film thickness profile after the first polishing, which is obtained by the film thickness sensor 52) and the response model described above (STEP 4 in FIG. 16). A method of creating the optimized recipe for the second polishing is performed in the same manner as in STEP 2 of FIG. 5 described above.

Next, the controller 30 causes the second polishing of the wafer W to be performed in accordance with the optimized polishing recipe for the second polishing in the second polishing unit to which the wafer W has been transferred in STEP 3 (see STEP 5 in FIG. 16). Next, the controller 30 causes the second polished wafer W to be transferred to the first cleaning unit 16 and/or the second cleaning unit 18 to be cleaned, and further the cleaned wafer W to be transferred to the drying unit 20 to be dried. Further, the controller 30 causes the wafer W after the second polishing to be transferred to the film thickness measuring device 8 (see FIG. 1), and obtains a film thickness profile of the wafer W after the second polishing (see STEP 6 in FIG. 16).

Next, the controller 30 causes the next wafer W to be transferred to the first polishing unit, and performs the first polishing of the next wafer W (see STEP 7 in FIG. 16). After the first polishing of the next wafer W is terminated, the controller 30 obtains the film thickness profile of the next wafer W after the first polishing by use of the film thickness sensor 52 while performing the water-polishing of the next wafer W (see STEP 8 in FIG. 16).

Next, the controller 30 causes the next wafer W after the first polishing to be transferred to the second polishing unit to performs the second polishing of the next wafer W (see STEP 9 in FIG. 16). At this time, the controller 30 corrects the response model for second polishing in order to create the optimized polishing recipe for the second polishing (see STEP 9 in FIG. 16). The correction of the response model for the second polishing of the next wafer W is performed based on the optimized polishing recipe for the second polishing of the previous wafer W and the film thickness profiles before and after the second polishing of the previous wafer W, as described in STEP 5 of FIG. 5.

Specifically, the controller 30 calculates the actual polishing amounts Rac of the second polishing in each of the monitored area D1 to Dm from the thickness profiles before and after the second polishing, of the wafer W that has already been first polished and second polished, and then calculates the correction factor K such that the predicted polishing amount R in the above equation (3) and the actual polishing amount Rac satisfy the above-described equation (4). Next, the controller 30 multiplies the above-described matrices C and D by K obtained from the equation (4) to calculate and store the corrected response coefficient matrix Cadj and the corrected offset amount matrix Dadj through the above-described equations (5) and (6).

Next, the controller 30 calculates, by use of the above-described optimization calculations, the optimized polishing recipe for the second polishing of the next wafer W, including at least the pressures of the pressurized fluid supplied to each of the pressure chambers 7*a* to 7*h* and the retainer chamber 34, and the polishing time, from the calculated Cadj and Dadj, and the target polishing amount R' in the second polishing of the next wafer W.

Next, the controller 30 performs the second polishing of the next wafer W with the optimized polishing recipe for the second polishing, which has been calculated (see STEP 12 in FIG. 16). Next, the controller 30 causes the next wafer W after the second polishing to be transferred to the first cleaning unit 16 and/or the second cleaning unit 18 to be cleaned, and then the cleaned next wafer W to be transferred to the drying unit 20 to be dried. Further, the controller 30 causes the next wafer W after the second polishing to be transferred to the film thickness measuring device 8, and obtains the film thickness of the wafer after the second polishing (see STEP 13 in FIG. 16).

Further, the controller 30 repeats STEPS 7 to 13 shown in FIG. 16. Specifically, the controller 30 obtains, before the second polishing of the further next wafer W in the second polishing unit, the film thickness profile of the further next wafer W before the second polishing by use of film thickness sensor 52. Further, the controller 30 corrects the response model for the second polishing used to polish the next wafer W, based on the film thickness profiles before and after the second polishing of the next wafer W. Next, the controller 30 creates the optimized polishing recipe for the second polishing of the further next wafer W based on the corrected response model. Next, the controller 30 causes the further next wafer W to be second-polished with the optimized polishing recipe for the second polishing, which has been calculated based on the corrected response model, and obtains a film thickness profile of the further next wafer W after the second polishing. In this manner, the response model for the second polishing is corrected each time the wafer W is polished, and the wafer W is polished with the optimized polishing recipe for the second polishing calculated based on the corrected response model, so that the film thickness profile of the next wafer W can be controlled more precisely.

According to this embodiment, even when several polishing processes are required, the film thickness profile of wafer W can be precisely controlled, while minimizing the reduction in throughput.

Figure 17:
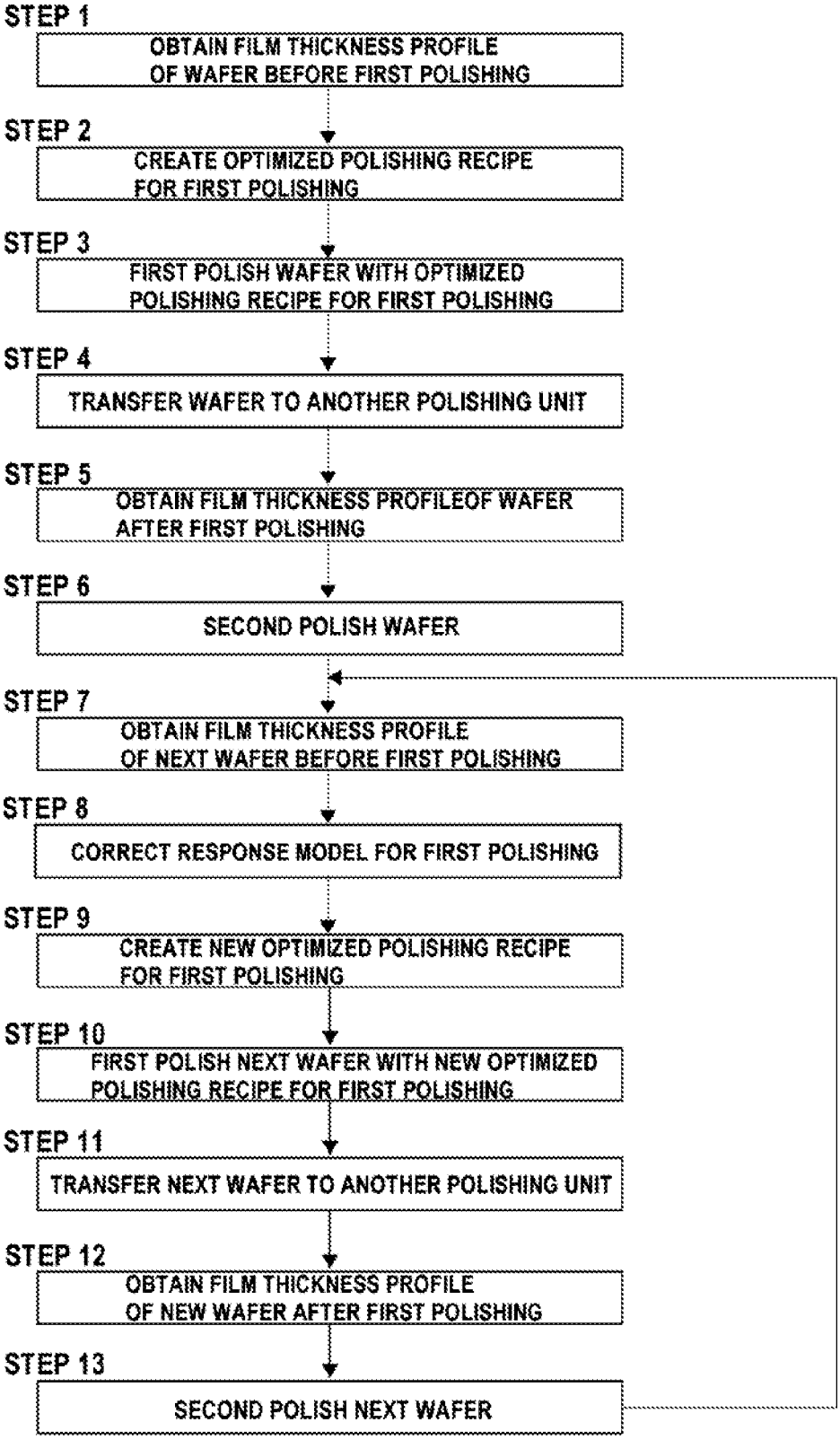
FIG. 17 is a flowchart showing a polishing method according to still another embodiment.

FIG. 17 is a flowchart showing the polishing method according to still another embodiment. STEPS of this embodiment, which will not be particularly described, are same as the STEPS of the flowchart shown in FIG. 16, and thus duplicated descriptions thereof will be omitted.

In the polishing method shown in the flowchart of FIG. 17, the controller 30 first causes the wafer W to taken out from the substrate cassette placed on the load port 12 (see FIG. 1) to be transferred to the film thickness measuring device 8, and obtains the film thickness profile of the wafer W before the first polishing (see STEP 1 in FIG. 17).

Next, the controller 30 creates the optimized polishing recipe for the first polishing of the wafer W based on the an thickness profile of wafer W before the first polishing and the response model described above (see STEP 2 in FIG.

17). This method of creating the optimized polishing recipe for the first polishing is performed in the same manner as STEP 2 in FIG. 5, which is described above. Next, the controller 30 causes the wafer W to be first-polished with the optimized polishing recipe for the first polishing (see STEP 3 in FIG. 17), and the wafer W to be transferred to the second polishing unit (e.g., polishing unit 14*b*) having the film thickness sensor 52 (see STEP 4 in FIG. 17).

Next, before performing the second polishing, the controller 30 obtains the film thickness profile of the wafer W after the first polishing by use of the film thickness sensor 52, while performing the water-polishing described above (see STEP 5 in FIG. 17). Next, the controller 30 performs the second polishing of the wafer W in the second polishing unit in accordance with a predetermined polishing recipe (see STEP 6 in FIG. 17). Next, the controller 30 causes the wafer W after the second polishing to be transferred to the first cleaning unit 16 and/or the second cleaning unit 18 to be cleaned, and then the cleaned wafer W to be transferred to the drying unit 20 to be dried.

Next, the controller 30 causes the next wafer W to be transferred to the film thickness measurement device 8, and obtains the film thickness profile of the next wafer W before the first polishing (see STEP 7 in FIG. 15). Next, the controller 30 performs the correction of the response model for the first polishing, based on the optimized polishing recipe for the first polishing of the wafer W and the film thickness profiles before and after the first polishing (see STEP 8 in FIG. 17). Next, the controller 30 creates the optimized polishing recipe for the first polishing of the next wafer W by use of the corrected response model for the first polishing (see STEP 9 in FIG. 17).

Next, the controller 30 causes the next wafer W to be first-polished with the created optimized polishing recipe (see STEP 10 in FIG. 17), and the next wafer W after the first polishing to be transferred to the second polishing unit (see STEP 11 in FIG. 17). In the second polishing unit, the film thickness profile of the next wafer W after the first polishing is obtained by the film thickness sensor 52 during the water-polishing (see STEP 12 of FIG. 17). Next, the second polishing of the next wafer W is performed (see STEP 13 in FIG. 17).

Further, the controller 30 repeats STEPS 7 to 13 shown in FIG. 17. Specifically, the controller 30 corrects the response model for the first polishing by use of the optimized polishing recipe for the first polishing of the next wafer W and the film thickness profiles before and after the first polishing of the next wafer W. Before first-polishing the further next wafer W in the first polishing unit, the film thickness measuring device 8 is used to obtain the film thickness profile before the first polishing of the further next wafer W. Further, based on the corrected response model for the first polishing and the film thickness profile of the further next wafer W before the first polishing, the controller 30 creates the optimized polishing recipe for the first polishing. Next, the controller 30 causes the further next wafer W to be first polished with the optimized polishing recipe for the first polishing, which has been created, and obtains the film thickness profile of the further next wafer W after the first polishing. In this manner, the response model for the first polishing is corrected each time the wafer W is polished, and the wafer W is polished with the optimized polishing recipe for the first polishing calculated based on the corrected response model, so that the film thickness profile of the next wafer W can be controlled more precisely.

In this embodiment also, the film thickness profile of the wafer W can be precisely controlled while minimizing the reduction in throughput even when several polishing processes are required.

Figure 18:
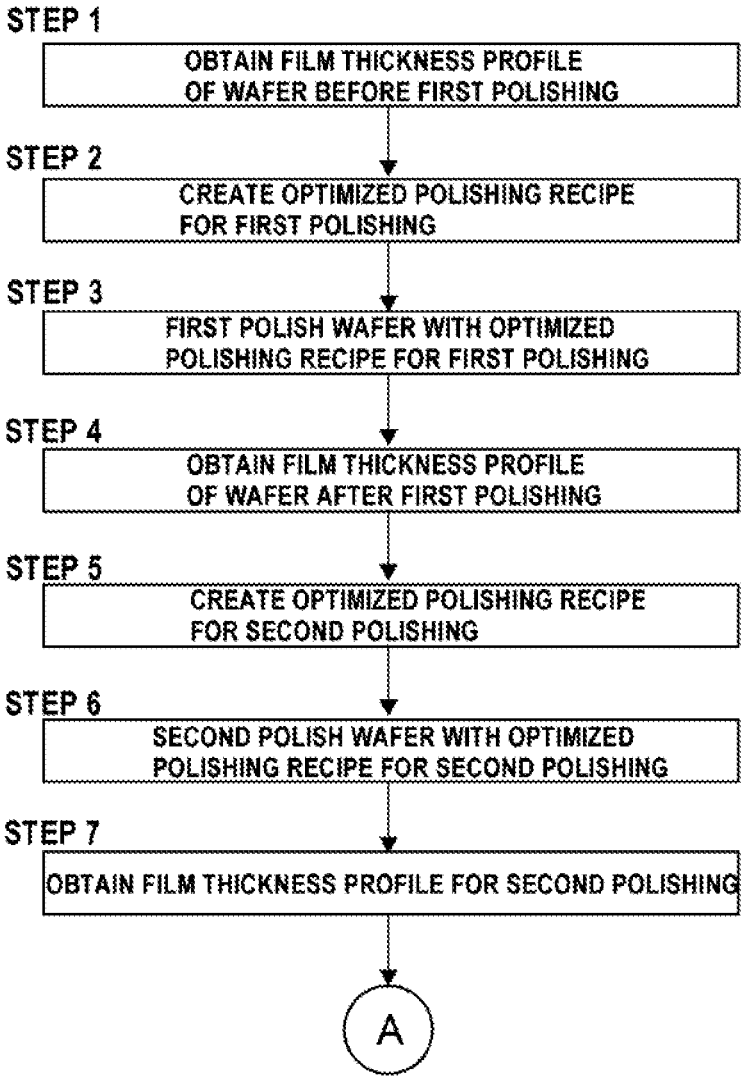
FIG. 18 is a first half of a flowchart showing a polishing method according to still another embodiment.
Figure 19:
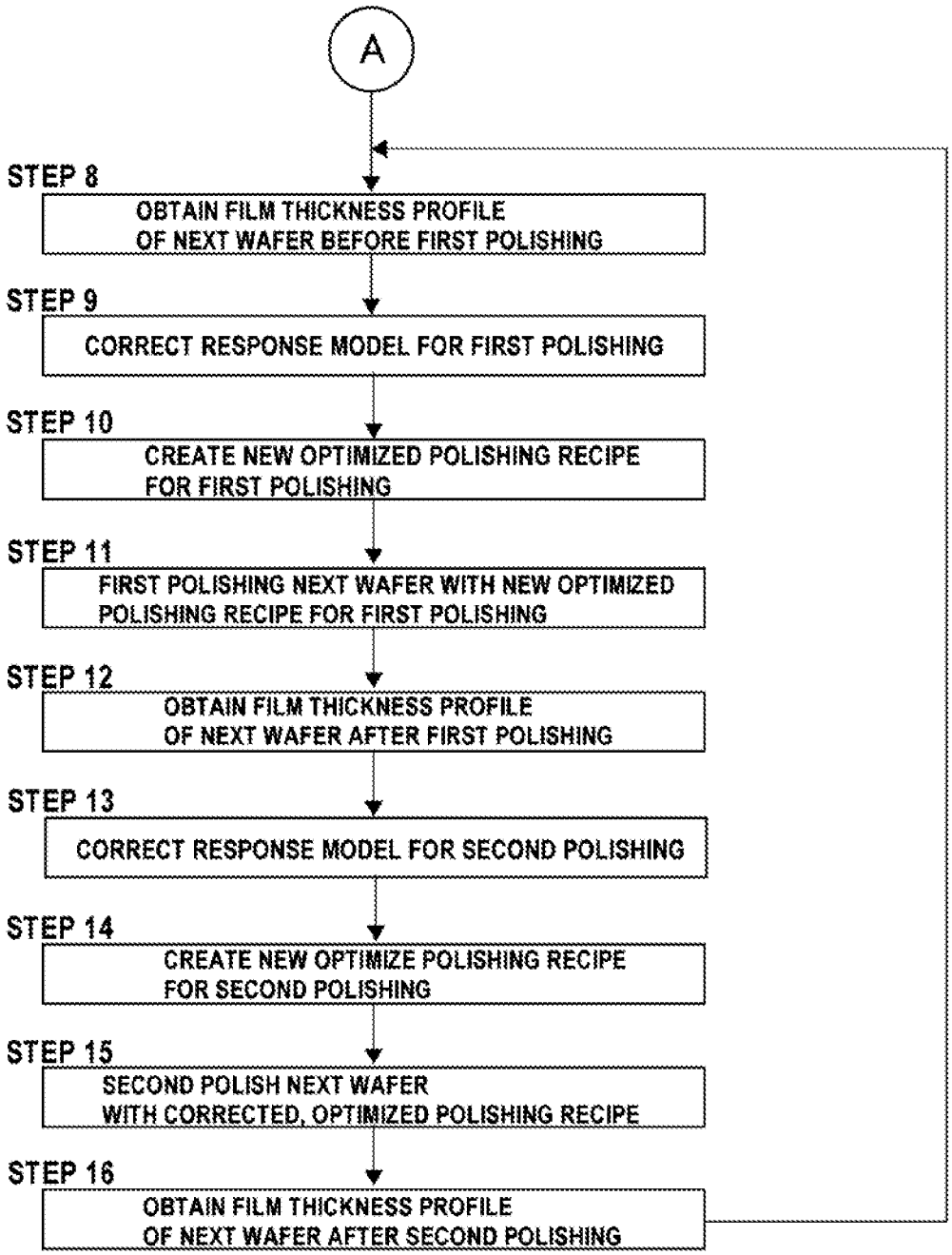
FIG. 19 is a latter half of a flowchart showing the polishing method according to still another embodiment.

FIG. 18 is a first half of a flowchart showing a polishing method according to still another embodiment, and FIG. 19 is a latter half of the flowchart showing the polishing method according to still another embodiment. STEPS of this embodiment, which will not be particularly described, are same as the STEPS of the flowcharts shown in FIGS. 16 and 17, and thus duplicate descriptions thereof will be omitted. In the polishing method shown in the flowchart which is illustrated in FIGS. 18 and 19, the first polishing and the second polishing are performed in a single polishing unit having the film thickness sensor 52. Therefore, the polishing apparatus can omit the film thickness measuring device 8 (see FIG. 1).

As shown in FIG. 18, the controller 30 first causes the wafer W to be taken out from the substrate cassette placed on the load port 12 (see FIG. 1), and to be transferred to the first polishing unit having the film thickness sensor 52. The film thickness profile of the wafer W before the first polishing is obtained by the film thickness sensor 52, while performing the water-polishing in the first polishing unit (see STEP 1 in FIG. 18).

Next, the controller 30 creates the optimized polishing recipe for the first polishing of the wafer W, based on the film thickness profile of the wafer W before the first polishing and the response model for the first polishing described above (see STEP 2 in FIG. 18). This method of creating the optimized polishing recipe for the first polishing is performed the same manner as STEP 2 in FIG. 5, which is described above. After terminating the water-polishing, the controller 30 causes the water-polishing to be terminated, and then the wafer to be first-polished in accordance with the optimized polishing recipe for the first polishing (see STEP 3 in FIG. 18).

Next, the controller 30 starts the water-polishing again after terminating of the first polishing, and obtains the film thickness profile of the wafer W after the first polishing during the water-polishing (see STEP 4 in FIG. 18). The film thickeners profile obtained after the first polishing corresponds to the film thickness profile before the second polishing. Therefore, the controller 30 creates the optimized polishing recipe for the second polishing, based on the film thickness profile obtained in STEP 4 and the response model for the second polishing described above (see STEP 5 in FIG. 18), and causes the wafer W to be second-polished with the optimized polishing recipe for the second polishing (see STEP 6 in FIG. 18).

When the second polishing is terminated, the controller 30 starts the water-polishing, and obtains the film thickness profile of the wafer W after the second polishing during the water-polishing (see STEP 7 in FIG. 18). Next, the controller 30 causes the second-polished wafer W to be transferred to the first cleaning unit 16 and/or the second cleaning unit 18 to be cleaned, and further the cleaned wafer W to be transferred to the drying unit 20 to be dried.

Next, the controller 30 causes the next wafer W to be transferred to the polishing unit, and obtains the film thickness profile of the next wafer W before the first polishing by use of the film thickness sensor 52 (see STEP 8 in FIG. 19). Further, the controller 30 corrects the response model for the first polishing by use of the optimized polishing recipe for the first polishing of the wafer W and the film thickness profiles before and after the first polishing (see STEP 9 in FIG. 19), and creates the optimized polishing recipe for the first polishing which is used for the first polishing of the next wafer W (see STEP 10 of FIG. 19). The creation of the optimized polishing recipe for the first polishing of the next wafer W is performed based on the previously corrected response model for the first polishing and the target polishing amount for the first polishing of the wafer W.

Next, the controller 30 causes the next wafer W to be first-polished with the optimized polishing recipe for the first polishing, which has been corrected (see STEP 11 in FIG. 19). Further, the controller 30 starts the water-polishing, and obtains, during the water-polishing, the film thickness profile of the next wafer W after the first polishing (see STEP 12 in FIG. 19).

Next, the controller 30 corrects the response model for the second polishing by use of the optimized polishing recipe for the second polishing of the wafer W and the film thickness profiles before and after the second polishing (see STEP 13 in FIG. 19), and create the optimized polishing recipe for the second polishing of the next wafer W (see STEP 14 in FIG. 19). The creation of the optimized polishing recipe for the next wafer W is performed based on the previously corrected response model for the second polishing and the target polishing amount for the second polishing of the wafer W. Next, the controller 30 causes the next wafer W to be second-polished with the optimized polishing recipe for the second polishing, which has been corrected (see STEP 15 in FIG. 19). After the second polishing is terminated, the controller 30 starts the water-polishing, and obtains, during the water-polishing, the film thickness profile of the next wafer W after the second polishing by use of the film thickness sensor 52 (see STEP 16 in FIG. 19). Further, the controller 30 repeats STEPS 8 to 16 in FIG. 19.

According to this embodiment, a plurality of polishing processes can be performed in a single polishing unit, enabling precise control of the film thickness profiles while minimizing the throughput reduction as much as possible. Furthermore, the film thickness measuring device 8 (see FIG. 1), which is generally expensive, can be omitted, and thus the polishing unit capable of precisely controlling film thickness profiles can be provided at a low cost.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus, comprising:

at least one polishing unit including a polishing table for supporting a polishing pad, and a substrate holder for pressing a substrate against the polishing pad, the substrate holder including an elastic membrane film to form a plurality of pressure chambers for pressing the substrate, a head body to which the elastic membrane is attached, and a retainer ring arranged so as to surround the substrate;

a film thickness measuring device configured to measure a film thickness profile of the substrate; and a controller configured to control at least operations of the polishing unit and the film thickness measuring device, the controller further configured to perform the operations comprising:

storing in advance, with respect to polishing of the substrate, a response model which is created based on variations in an amount of polishing between monitored areas of the substrate due to variations in a pressure of a pressurized fluid supplied to each of the pressure chambers, the response model calculating predicted polishing amounts in each of the monitored areas, and obtaining the film thickness profile of the substrate before polishing by use of the film thickness measuring device;

causing the substrate to be polished with an optimized polishing recipe including at least the pressures of the pressurized fluid supplied to each of the plurality of pressure chambers and a polishing time, the optimized polishing recipe being created based on the response model and a target polishing amount, which is a difference between the film thickness profile of the substrate before polishing and a target film thickness of the substrate; and causing a next substrate to be polished with a new optimized polishing recipe which is created based on a target polishing amount of the next substrate and a response model corrected by use of the optimized polishing recipe so as to match the predicted polishing amounts with actual polishing amounts, and the film thickness profile of the substrate before polishing and a film thickness profile of the substrate after polishing, the new optimized polishing recipe including at least the pressures of the pressurized fluid supplied to each of the plurality of pressure chambers and the polishing time, wherein the response model comprises an equation R, where $R=Tp\cdot(C\cdot X+D)$, wherein R represents a matrix consisting of the predicted polishing amounts in each of the monitored areas of the substrate, Tp represents the polishing time, C represents a matrix consisting of response coefficients in each of the monitored areas of the substrate, X represents a matrix consisting of the pressures of the pressurized fluid supplied to each of the pressure chambers, and D represents a matrix consisting of offset amounts of each of the monitored areas in the substrate, the response coefficients are amounts of increase in a polishing rate per unit polishing pressure, and the respective offset amount is calculated such that a predicted polishing rate is equal to an actual polishing rate obtained by polishing of the substrate with a reference polishing recipe.

2. The polishing apparatus according to claim 1, wherein the optimized polishing recipe is created using an optimization calculation that minimizes an objective function including at least a term for difference between the target polishing amount and the predicted polishing amounts calculated using the response model.

3. The polishing apparatus according to claim 2, wherein the objective function includes a term for differences between the pressures of the pressurized fluid of the optimized polishing recipe and preset reference pressure values of the pressurized fluid, and/or a term for differences between the pressures of the pressurized fluid of the optimized polishing recipe and pressures of the pressurized fluid used in polishing of a previous substrate.

4. The polishing apparatus according to claim 2, wherein the optimization calculation is quadratic programming method.

5. The polishing apparatus according to claim 1, wherein a number of the monitored areas is greater than a number of the plurality of pressure chambers.

6. The polishing apparatus according to claim 1, wherein the response model is a response model created by further taking into consideration variation in an amount of polishing between the monitored areas of the substrate due to variation in a pressing force of the retainer ring on the polishing pad, and the optimized polishing recipe further includes the pressing force of the retainer ring.

7. The polishing apparatus according to claim 1, wherein the film thickness measuring device is configured to measure a film thickness at a plurality of measurement points set in each of the plurality of monitored areas.

8. The polishing apparatus according to claim 1, further comprising a plurality of local-load exerting devices for applying a local load to a part of the retainer ring, wherein the response model is created by further taking into consideration variation in an amount of polishing between the monitored areas due to variation in the local load.

9. A polishing method in which a substrate held by a substrate holder is pressed against a polishing pad supported by a polishing table to thereby be polished, the substrate holder including an elastic membrane film to form a plurality of pressure chambers for pressing the substrate, a head body to which the elastic membrane is attached, and a retainer ring arranged so as to surround the substrate, comprising:

obtaining a film thickness profile of the substrate before polishing by use of a film thickness measuring device;

polishing the substrate with an optimized polishing recipe including at least pressures of a pressurized fluid supplied to each of the plurality of pressure chambers and a polishing time, the optimized polishing recipe being created based on a response model and a target polishing amount, which is a difference between the film thickness profile of the substrate before polishing and a target film thickness of the substrate; and polishing a next substrate with a new optimized polishing recipe which is created based on a target polishing amount of the next substrate and a response model corrected by use of the optimized polishing recipe so as to match predicted polishing amounts with actual polishing amounts, and the film thickness profile of the substrate before polishing and a film thickness profile of the substrate after polishing, the new optimized polishing recipe including at least the pressures of the pressurized fluid supplied to each of the plurality of pressure chambers and the polishing time, wherein the response model is a model created based on variations in an amount of polishing between monitored areas of the substrate due to variations in a pressure of a pressurized fluid supplied to each of the pressure chambers, the response model calculating the predicted polishing amounts in each of the monitored areas, the response model comprises an equation R, where $R=Tp\cdot(C\cdot X+D)$, wherein R represents a matrix consisting of the predicted polishing amounts in each of the monitored areas of the substrate, Tp represents the polishing time, C represents a matrix consisting of response coefficients in each of the monitored areas of the substrate, X represents a matrix consisting of the pressures of the pressurized fluid supplied to each of the pressure chambers, and D represents a matrix consisting of offset amounts of each of the monitored areas in the substrate, the response coefficients are amounts of increase in a polishing rate per unit polishing pressure, and the respective offset amount is calculated such that a predicted polishing rate is equal to an actual polishing rate obtained by polishing of the substrate with a reference polishing recipe.

10. The polishing method according to claim 9, wherein the optimized polishing recipe is created using an optimization calculation that minimizes an objective function including at least a term for difference between the target polishing amount and the predicted polishing amounts calculated using the response model.

11. The polishing method according to claim 10, wherein the objective function includes a term for differences between the pressures of the pressurized fluid of the optimized polishing recipe and preset reference pressure values of the pressurized fluid, and/or a term for differences between the pressures of the pressurized fluid of the optimized polishing recipe and pressures of the pressurized fluid used in polishing of a previous substrate.

12. The polishing method according to claim 10, wherein the optimization calculation is quadratic programming method.

13. The polishing method according to claim 9, wherein a number of the monitored areas of the substrate is greater than a number of the plurality of pressure chambers.

14. The polishing method according to claim 9, wherein the response model is a response model created by further taking into consideration variation in an amount of polishing between the monitored areas of the substrate due to variation in a pressing force of the retainer ring on the polishing pad, and the optimized polishing recipe further includes the pressing force of the retainer ring.

15. The polishing method according to claim 9, wherein the film thickness measuring device is configured to measure a film thickness at a plurality of measurement points set in each of the plurality of monitored areas.

16. The polishing method according to claim 9, wherein the response model is created by further taking into consideration variation in an amount of polishing between the monitored areas due to variation in a local load applied to a part of the retainer ring by a plurality of local-load exerting devices.

* * * * *